US007830097B2

(12) United States Patent
Kunimatsu

(10) Patent No.: US 7,830,097 B2
(45) Date of Patent: Nov. 9, 2010

(54) SEMICONDUCTOR CIRCUIT FOR DRIVING LIGHT EMITTING DIODE, AND LIGHT EMITTING DIODE DRIVING APPARATUS

(75) Inventor: Takashi Kunimatsu, Osaka (JP)

(73) Assignee: Panasonic Corporation, Osaka (JP)

( * ) Notice: Subject to any disclaimer, the term of this patent is extended or adjusted under 35 U.S.C. 154(b) by 743 days.

(21) Appl. No.: 11/720,868

(22) PCT Filed: Dec. 14, 2005

(86) PCT No.: PCT/JP2005/022952

§ 371 (c)(1),
(2), (4) Date: Jun. 5, 2007

(87) PCT Pub. No.: WO2006/064841

PCT Pub. Date: Jun. 22, 2006

(65) Prior Publication Data

US 2009/0224686 A1 Sep. 10, 2009

(51) Int. Cl.
*H05B 37/02* (2006.01)

(52) U.S. Cl. ..... 315/291; 315/209 R; 315/307

(58) Field of Classification Search ..... 315/151, 315/158, 169.1, 169.3, 200 A, 209 R, 224, 315/238, 241 P, 241 R, 283, 291, 307
See application file for complete search history.

(56) References Cited

U.S. PATENT DOCUMENTS 6,690,146 B2 * 2/2004 Burgyan et al. ..... 323/271
2002/0158590 A1 * 10/2002 Saito et al. ..... 315/291
2005/0110469 A1 * 5/2005 Inaba et al. ..... 323/222

FOREIGN PATENT DOCUMENTS

| | | | |
|---|---|---|---|
| JP | 05-094151 | A | 4/1993 |
| JP | 06-242733 | A | 9/1994 |
| JP | 09-045481 | A | 2/1997 |
| JP | 11-135274 | A | 5/1999 |
| JP | 2000-030877 | A | 1/2000 |
| JP | 2000-162677 | A | 6/2000 |
| JP | 2001-313423 | A | 11/2001 |
| JP | 2004-039289 | A | 2/2004 |
| JP | 2004-093657 | A | 3/2004 |
| JP | 2004-214144 | A | 7/2004 |
| WO | WO 01/045470 | A | 6/2001 |

OTHER PUBLICATIONS

International Search Report for Application No. PCT/JP2005/022952, dated Mar. 28, 2006.

* cited by examiner

*Primary Examiner*—Douglas W Owens
*Assistant Examiner*—Jae K Kim
(74) *Attorney, Agent, or Firm*—RatnerPrestia

(57) ABSTRACT

A light emitting diode drives a semiconductor circuit in order to drive a light emitting diode that emits light by applying the output voltage of the rectifier circuit. The light emitting diode includes a switching element connected between the light emitting diode and the ground potential. An input voltage detection circuit detects the output voltage of the rectifier circuit to output a light emitting signal or a extinction signal. A current detection circuit detects the current flowing into the switching element. A control circuit intermittently controls on/off of the switching element at a predetermined oscillating frequency based on the output signal of the current detection circuit while the input voltage detection circuit is outputting the light emitting signal.

19 Claims, 19 Drawing Sheets

Vin
2
1
IL
3
4
LED
5
DRN
VD
6
7
VJ
9
8
11
REGULATOR
12
START/STOP CIRCUIT
21
20
22
Vst
Vin21
23
Vcc
IN
VCC
24
ID
10
25
GATE
13
26
GND
GND-SRCE
ON-STATE BLANKING PULSE GENERATOR
14
15
S Q
R Q
16
17
18
Vsn
19
MXDTY
CLK

SEMICONDUCTOR CIRCUIT FOR DRIVING LIGHT EMITTING DIODE, AND LIGHT EMITTING DIODE DRIVING APPARATUS

This Application is a U.S. National Phase Application of PCT International Application PCT/JP2005/022952.

TECHNICAL FIELD

The present invention relates to a semiconductor circuit for driving a light emitting diode and a light emitting diode driving apparatus using the same. In particular, the present invention relates to an LED illuminating apparatus.

BACKGROUND ART

A light emitting diode driving semiconductor circuit for driving a light emitting diode (LED) and a light emitting diode driving apparatus including the same are recently developed and put into practical use. Conventional light emitting diode driving apparatus (illuminating apparatus) is disclosed in JP-A-2000-30877 (patent document 1). The conventional light emitting diode driving apparatus will be described with reference to FIG. 19.

The conventional light emitting diode driving circuit in FIG. 19 includes an alternating-current power supply AC, a full-wave rectifier circuit DB connected to the alternating-current power supply AC, LED arrays 1, . . . , m (m is an integer greater than or equal to two) of a plurality of lines formed by connecting in series a plurality of LEDs, current-limiting elements Z1, . . . , Zm such as resistors each having one end connected to a cathode side of each LED array 1, . . . , m and other end connected in common to a negative output terminal of the full-wave rectifier circuit DB, and a switching means SW selectively switching to connect an anode side of each LED array 1, . . . , m to either a positive output terminal of the full-wave rectifier circuit DB or one end of the alternating-current power supply AC.

The conventional light emitting diode driving apparatus selects either half-wave conduction by the alternating-current power supply or full-wave conduction by the full-wave rectifier circuit by means of the switching means SW with respect to each LED array of a plurality of lines. A current value flowing in each LED array 1, . . . , m is thereby determined. For example, the illuminating apparatus of m=2 has a dimming function of four steps.

Patent document 1: JP-A-2000-30877

DISCLOSURE OF INVENTION

Problems to be Solved by the Invention

The conventional light emitting diode driving apparatus has the following problems. The power loss is large since the current value of each LED array is determined by the current-limiting element such as a transistor. Furthermore, non-step adjustment is difficult since adjustment of luminosity and chromaticity can be adjusted only by the line number of the LED array. In order to increase the steps of adjustment, a plurality of switching elements and LED arrays become necessary, which increases the number of circuit components, and thus the light emitting diode driving apparatus cannot be miniaturized. In particular, the light emitting diode driving apparatus that is not small is not suitable for bulb type LED illumination. When the conventional light emitting diode driving apparatus is used for the light emission of white LED, if the forward current value is set large to obtain the predetermined luminosity, the chromaticity tends to change therewith since the luminosity and the chromaticity depend on the forward current of the LED.

In view of the above problems, the present invention aims to provide a light emitting diode driving semiconductor circuit that controls the luminosity and the chromaticity with a simple configuration and that has small power loss, and a light emitting driving apparatus using the same.

Means for Solving the Problems

The present invention relates to a light emitting diode driving semiconductor circuit is connected to a light emitting diode block including a rectifier circuit that rectifies an alternating-current voltage and one or more light emitting diodes to which a voltage output from the rectifier circuit is applied to emit light. The semiconductor diode driving semiconductor circuit includes a first switching element that is connected between the light emitting diodes and a ground potential; and a control circuit block that controls on/off of the first switching element. The control circuit block includes an input voltage detection circuit that detects the voltage output from the rectifier circuit and compares the detected voltage with a predetermined value to output a light emitting signal or a extinction signal for controlling emission or extinction of the light emitting diode, a current detection circuit that detects a current flowing into the first switching element, and a control circuit that intermittently controls on/off of the first switching element at a predetermined oscillating frequency based on an output signal of the current detection circuit so that the current flowing into the light emitting diode is constant while the input voltage detection circuit is outputting the light emitting signal.

The "Control circuit" herein refers to a circuit including an oscillator 19, an AND circuit 13, an AND circuit 17, an OR circuit 16, and an RS flip-flop circuit 15 in FIG. 1 of the first embodiment.

According to the present invention, since the current flowing in the light emitting diodes can be controlled to a constant current even if the output voltage of the rectifier circuit is fluctuating, a light emitting diode driving semiconductor circuit having a constant chromaticity can be realized. According to the present invention, the voltage when the light emitting diode emits light/quenches light can be defined to an arbitrary voltage value. The ratio between the period in which the current flows into the light emitting diode and the period in which the current does not flow thereto in one period of the output voltage of the rectifier circuit can be adjusted. The light emitting diode driving semiconductor circuit having a constant luminosity is thereby realized.

The light emitting diode block may further includes a choke coil connected to the rectifier circuit; and a diode having one end connected to the choke coil and other end connected to the light emitting diode to supply back electromotive force generated at the choke coil to the light emitting diode. According to such configuration, the current flows into the light emitting diode in the direction of choke coil→light emitting diode→first switching element when the first switching element is in the ON state. When the switching element is in the OFF state, the current flows into a circuit loop configured by the choke coil, the light emitting diode and the diode in the direction of choke coil→light emitting diode→diode, and the light emitting diode block operates as a voltage drop chopper. Therefore, a light emitting diode driving semiconductor circuit having high power conversion efficiency is realized according to the present invention. Furthermore, a compact light emitting diode driving semiconductor circuit having reduced number of components is realized.

The light emitting diode driving semiconductor circuit may further include a junction type FET to which the output voltage of the rectifier circuit is applied directly or by way of the light emitting diode. The control circuit block further may include an input terminal and is driven by applying an output voltage of the junction type FET to the input terminal.

According to the present invention, the high voltage applied to the high potential side of the junction type FET (Field-Effect Transistor) is pinched off at the low voltage on the low potential side of the junction type FET due to the pinch off effect of the junction type FET. According to such configuration, the power can be supplied from the switching element block to the control circuit block, and thus the light emitting diode driving semiconductor circuit having reduced power loss due to start resistors and the like, and having high power conversion efficiency is realized.

The junction type FET may be connected between the light emitting diode and the first switching element in series with the first switching element, and the connecting point of the junction type FET and the first switching element may be connected to the input terminal.

One end of the junction type FET may be connected between the light emitting diode and the first switching element, and other end of the junction type FET may be connected to the input terminal.

The junction type FET may be connected between the rectifier circuit and the input terminal.

The control circuit block further may be include a regulator that is connected to the input terminal and receives the output voltage of the junction type FET to output a constant reference voltage when the output voltage of the junction type FET is greater than or equal to a predetermined value. Each circuit in the control circuit block may is driven by applying the constant reference voltage.

Since the reference voltage during the operation of the control circuit can be maintained constant by arranging the regulator, a stable control of the switching element is realized.

In case that the regulator outputs a start signal or a stop signal of on/off control of the first switching element based on whether or not the output voltage of the junction type FET is greater than or equal to the predetermined value, the light emitting diode driving semiconductor circuit may further include a start/stop circuit that outputs the stop signal to the control circuit when the regulator outputs the stop signal, and that outputs the light emitting signal or the extinction signal of the input voltage detection circuit to the control circuit when the regulator outputs the start signal.

When the reference voltage is smaller than the predetermined value, the control circuit does not perform the on/off control of the switching element. According to the present invention, the control circuit starts to control after the time the reference voltage reaches the predetermine voltage, and thus the control circuit can perform a stable operation.

The input voltage detection circuit may include a plurality of resistors which are connected in series and to which the voltage output by the rectifier circuit is applied directly or by way of a junction type FET, and a comparator having a positive input terminal for inputting a direct-current voltage divided by the plurality of resistors and a negative input terminal for inputting an input reference voltage of the predetermined value.

According to such configuration, the light emitting diode driving semiconductor circuit, in which the period of emitting light and the period of extinction during the doubling period (100 Hz/120 Hz when general commercial power supply is used) of the frequency of the alternating-current power supply are accurately defined, is realized.

The voltage value for emitting or quenching the light emitting diode may be adjusted by changing the value of the input reference voltage.

Accordingly, since the light emitting period and the extinction period of the light emitting diode can be adjusted, the light emitting diode driving semiconductor circuit capable of adjusting the luminosity and having high power conversion efficiency is realized.

The light emitting diode driving semiconductor circuit further may include a first external input terminal for inputting a light emitting voltage; and a second external input terminal for inputting a extinction voltage having a potential higher than the light emitting voltage. The input voltage detection circuit may include a plurality of resistors which are connected in series and to which the voltage output by the rectifier circuit is applied directly or by way of the junction type FET, a first comparator having a negative input terminal connected to an intermediate connecting point of the plurality of resistors and a positive input terminal connected to the first external input terminal, a second comparator having a positive input terminal connected to an intermediate connecting point of the plurality of resistors and a negative input terminal connected to the second external input terminal, and a NOR circuit having input terminals connected to output terminals of the first comparator and the second comparator. The output terminal of the NOR circuit may be connected to the start/stop circuit.

According to such configuration, the level of the light emitting voltage and the extinction voltage in one period can be individually set, and thus a light emitting diode semiconductor circuit capable of performing a more complex luminosity adjustment and having high power conversion efficiency is realized.

The input voltage detection circuit may include a plurality of resistors which are connected in series and to which the voltage output by the rectifier circuit is applied directly or by way of a junction type FET to output a first divided voltage and a second divided voltage having a potential lower than the first divided voltage, a first comparator having a positive input terminal for inputting the first divided voltage and a negative input terminal for inputting a input reference voltage, a second comparator having a negative input terminal for inputting the second divided voltage and the positive input terminal for inputting the input reference voltage, and an AND circuit for inputting the output signals of the first and second comparators. The output terminal of the AND circuit may be connected to the start/stop circuit.

According to the above configuration, the upper limit value and the lower limit value of the voltage level capable of the on/off control of the switching element are set with respect to the change in the voltage output from the rectifier circuit. The input voltage detection circuit acts as a protective circuit when an abnormal high voltage is applied, and thus a safer light emitting diode driving apparatus can be realized.

The input voltage detection circuit may input the output voltage of the rectifier circuit by way of a resistor connected between the rectifier circuit and the input voltage detection circuit.

According to the above configuration, the upper limit value and the lower limit value of the voltage level capable of the on/off control of the switching element can be arbitrarily set with respect to the change in the voltage output from the rectifier circuit by changing the resistance value of the resistor connected between the rectifier circuit and the input voltage detection circuit. A safer light emitting diode driving semiconductor circuit capable of performing complex luminosity adjustment is thus realized. The power loss by the resistor of the input voltage detection circuit can be reduced by using a high resistor for the resistor connected between the rectifier circuit and the control circuit block.

The current detection circuit may detect the current flowing into the first switching element by comparing the on-voltage of the first switching element with a detection reference voltage acting as a reference.

According to the present invention, the power loss is reduced, and current detection of the switching element, that is, the detection of the current peak value flowing in the light emitting diode is realized. Therefore, the light emitting diode driving semiconductor circuit having high power conversion efficiency is realized according to the present invention.

The light emitting diode driving semiconductor circuit may further include a second switching element having one end that is connected to the connecting point of the light emitting diode and the first switching element to switch by the same control as the first switching element from the control circuit to cause a current to flow, the current being smaller than the current flowing through the first switching element and having a constant current ratio with respect to the current flowing through the first switching element; and a resistor connected in series between other end of the switching element and the ground potential. The current detection circuit may compare the voltage at both ends of the resistor with the detection reference voltage acting as a reference to detect the current of the first switching element.

According to the above configuration, the large current is not directly detected by the detector, and thus the power loss is reduced, and current detection of the switching element, that is, the detection of the current peak value flowing in the light emitting diode is realized. According to the present invention, the light emitting diode driving semiconductor circuit having high power conversion efficiency is realized.

The ON-period in the intermittent on/off control of the first switching element may be changed by changing the value of the detection reference voltage, so that the light emitting diode driving semiconductor circuit may be adjust a constant current level flowing in the light emitting diode.

According to the above configuration, a light emitting diode driving semiconductor circuit having control function for luminosity and chromaticity and having high power conversion efficiency is realized.

A soft start circuit may be connected between an external detection terminal for inputting the detection reference voltage and the current detection circuit; and the soft start circuit may output the detection reference voltage so as to gradually increase until reaching a constant value when the light emitting signal is input from the start/stop circuit.

According to the above configuration, a light emitting diode driving semiconductor circuit that prevents the incoming current generated in time of starting, and that gradually increases the luminosity of the light emitting diode is realized.

A light emitting diode driving apparatus of the present invention includes a rectifier circuit that rectifies an alternating-current voltage; one or more light emitting diodes to which a voltage output from the rectifier circuit is applied to emit light; and the light emitting diode driving semiconductor circuit.

According to the present invention, since the current flowing in the light emitting diode can be controlled to a constant current even if the input voltage is fluctuating, a light emitting diode driving apparatus having a constant chromaticity is achieved. Furthermore, since the light emitting/extinction voltage for controlling the first switching element is defined at the rectified arbitrary input voltage, the ratio between the period in which the current flows and the period in which the current does not flow in one period can be adjusted, and the light emitting diode driving apparatus having a constant luminosity is achieved.

The light emitting diode driving apparatus may further include a choke coil connected between the rectifier circuit and the light emitting diode; and a diode having one end connected to the choke coil and other end connected to the light emitting diode to supply back electromotive force generated at the choke coil to the light emitting diode. A reverse recovery time of the diode is preferably less than or equal to 100 nsec.

The current flows in the light emitting diode in the direction of choke coil→light emitting diode→first switching element when the first switching element is in the ON state. When the switching element is in the OFF state, the current flows in a circuit loop configured by the choke coil, the light emitting diode and the diode in the direction of choke coil→light emitting diode→diode. The light emitting diode driving apparatus operates as a voltage drop chopper. Therefore, according to the present invention, a compact light emitting diode driving semiconductor circuit having high power conversion efficiency and reduced number of components is realized. Furthermore, since the reverse recovery time of the diode is less than or equal to 100 nsec, the power loss in the first switching element can be reduced in a transition state of when the first switching element turns from off to on.

Effect of the Invention

According to the present invention, a compact light emitting diode driving semiconductor circuit having high power conversion efficiency and capable of controlling the luminosity and chromaticity, and a light emitting diode driving apparatus using the same are achieved.

DESCRIPTION OF NUMERALS

Figure 1:
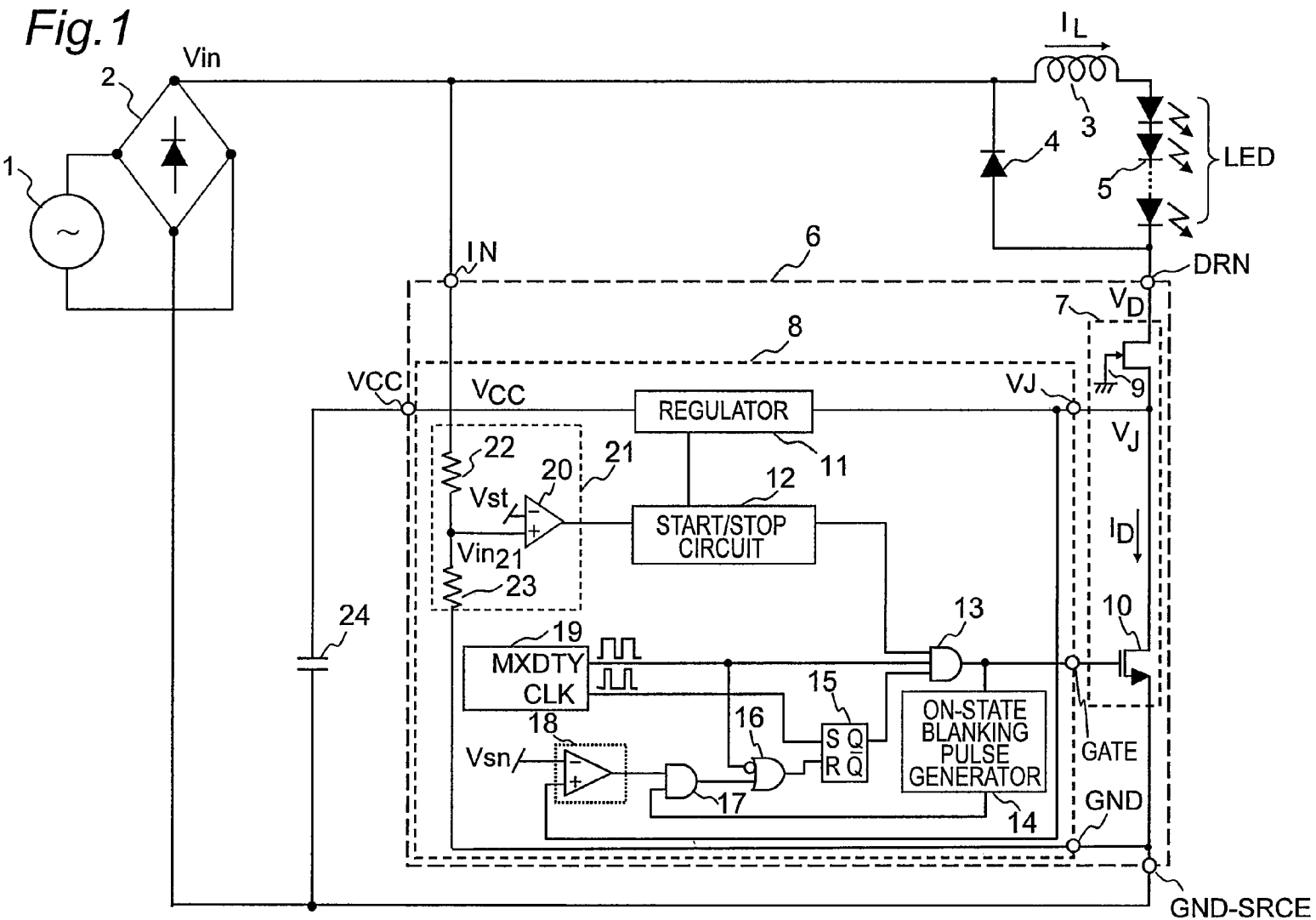
FIG. 1 is a circuit diagram showing a light emitting diode driving apparatus of a first embodiment of the present invention.

1 Alternating-current power supply
2 Rectifier circuit
3 Choke coil
4 Diode
5 Light emitting diode
6 Light emitting diode driving semiconductor circuit
7 Switching element block
8 Control circuit block
9 Junction type FET
10 Switching element
11 Regulator
12 Start/stop circuit
13, 17, 36, 47 AND circuit
14 ON-state blanking pulse generator
15 RS flip-flop circuit
16, 37 OR circuit
18 Drain current detection circuit
19, 35 Oscillator
20, 28, 29, 34, 38, 39 Comparator
21 Input voltage detection circuit
22, 23, 26, 30, 31, 32, 40, 41, 42, 43 Resistor
24 Capacitor
25 Switching element
27 NOR circuit
33 Soft start circuit
IN Rectified voltage terminal
DRN High potential side terminal
VJ Input terminal
GATE Output terminal
VCC Reference voltage terminal
GND Ground terminal
GND-SRCE Low potential side terminal
SN External detection terminal
ST External input terminal
INH High level input terminal
INL Low level input terminal

BEST MODE FOR CARRYING OUT THE INVENTION

The best mode for carrying out the light emitting diode driving semiconductor circuit and the light emitting diode driving apparatus of the present invention will now be described with reference to FIG. 1 to FIG. 15.

First Embodiment

The light emitting diode driving semiconductor circuit and the light emitting diode driving apparatus using the same of the first embodiment of the present invention will be described using FIG. 1 to FIG. 4. FIG. 1 shows the light emitting diode driving semiconductor circuit and the light emitting diode driving apparatus of the first embodiment. The light emitting diode driving apparatus of the present embodiment shown in FIG. 1 includes a rectifier circuit (full-wave rectifier circuit) 2 connected to an alternating-current power supply 1 for generating the alternating-current voltage; a choke coil 3 connected to the high potential side of the rectifier circuit 2; a light emitting diode 5 connected in series with the choke coil 2; a diode 4 connected in parallel with the choke coil 3 and the light emitting diode 5 to supply back electromotive force generated in the choke coil 3 to the light emitting diode 5; a light emitting diode driving semiconductor circuit 6 connected to the cathode terminal of the light emitting diode 5; and a capacitor 24 connected between a reference voltage terminal VCC of the light emitting diode driving semiconductor circuit 6 and a low potential side terminal GND-SRCE being the ground potential. The low potential side of the rectifier circuit 2 is connected to the low potential side terminal GND-SRCE.

The light emitting diode 5 has an anode terminal connected to the choke coil 3 and a cathode terminal connected to the anode terminal of the diode 4 and the high potential side terminal DRN of the light emitting diode driving semiconductor circuit 6. In FIG. 1, the light emitting diode 5 is a light emitting diode group in which a plurality of light emitting diodes are connected in series. However, the number of light emitting diode 5 is not limited to FIG. 1, and only one or more light emitting diodes may be required. Further, in the present embodiment, the light emitting diode 5 is a white light emitting diode. The rectifier circuit 2, the choke coil 3, the diode 4, and the light emitting diode 5 of FIG. 1 make up the "light emitting diode block".

The light emitting diode driving semiconductor circuit 6 includes a switching element block 7 and a control circuit block 8. Moreover, the light emitting diode driving semiconductor circuit 6 includes four terminals (rectified voltage terminal IN, high potential side terminal DRN, low potential side terminal GND-SRCE, reference voltage terminal VCC) to connect with the outside. The rectified voltage terminal IN is connected between the high potential side of the rectifier circuit 2 and the choke coil 3 to input the full-wave rectified voltage Vin. The high potential side terminal DRN inputs the voltage $V_D$ output by the light emitting diode 5. The low potential side terminal GND-SRCE is connected to the ground terminal GND of the control circuit block 8 to become the ground potential. The reference voltage terminal VCC is connected to the capacitor 24.

The switching element block 7 includes a junction type FET 9 and a switching element 10 (first switching element) which are connected in series. The high potential side of the junction type FET 9 is connected to the high potential side terminal DRN of the light emitting diode driving semiconductor circuit 6. An input terminal VJ of the control circuit block 8 is connected to the connecting point of the low potential side of the junction type FET 9 and the high potential side of the switching element 10. The low potential side of the switching element 10 is connected to the low potential side terminal GND-SRCE of the light emitting diode driving semiconductor circuit 6. The control terminal of the switching element 10 is connected to the output terminal GATE of the control circuit block 8.

The control circuit block 8 will now be described. The control circuit block 8 is driven when the low potential side voltage $V_J$ of the junction type FET 9 is input to the input terminal VJ. The input low potential side voltage $V_J$ is supplied to a regulator 11 and a drain current detection circuit 18.

The regulator 11 has one end connected to the input terminal VJ and other end connected to the reference voltage terminal VCC. The regulator 11 outputs the low potential side voltage $V_J$ as the reference voltage Vcc when the input low potential side voltage $V_J$ is smaller than the starting voltage $Vcc_0$, and outputs a certain voltage $Vcc_0$ as the reference voltage Vcc when the input low potential side voltage $V_J$ is greater than or equal to the starting voltage $Vcc_0$. The voltage Vcc output by the regulator 11 is output from the reference voltage terminal VCC and accumulated in the capacitor 24. The internal circuit in the control circuit block 8 starts to operate when the reference voltage Vcc reaches the voltage value $Vcc_0$.

The regulator 11 further outputs a low (L) signal, which is a stop signal, to a start/stop circuit 12 when the low potential side voltage $V_J$ is smaller than the starting voltage $Vcc_0$, and thereby the start/stop circuit 12 performs a control so as not to start the on/off control of the switching element 10. The regulator 11 outputs a high (H) signal, which is a start signal, to the start/stop signal circuit 12 when the low potential side voltage $V_J$ is greater than or equal to the starting voltage $Vcc_0$, and thereby the start/stop circuit 12 performs a control to start the on/off control of the switching element 10.

An input voltage detection circuit 21 includes two resistors 22, 23 connected in series. The high potential side of the resistor 22 is connected to the rectified voltage terminal IN, and the low potential side of the resistor 23 is connected to the ground terminal GND. The full-wave rectified voltage Vin output by the rectifier circuit 2 is divided by the resistor 22 and the resistor 23, and the divided voltage $Vin_{21}$ is output from an intermediate connecting point of the resistor 22 and the resistor 23.

The input voltage detection circuit 21 further includes a comparator 20 having a positive input terminal connected with the intermediate connecting point of the resistor 22 and the resistor 23 and the negative input terminal for receiving the input reference voltage Vst that becomes the reference. The comparator 20 outputs the low (L) signal when the voltage $Vin_{21}$ is smaller than the input reference voltage Vst, and outputs the high (H) signal when the voltage $Vin_{21}$ is greater than or equal to the input reference voltage Vst. The low (L) signal output by the input voltage detection circuit 21 is an extinction signal for quenching the light emitting diode 5, and the high (H) signal is the light emitting signal for emitting the light emitting diode 5. The output terminal of the comparator 20 is connected to the start/stop circuit 12.

The start/stop circuit 12 receives the start signal (high signal) or the stop signal (low signal) from the regulator 11, and also receives the light emitting signal (high signal) or the extinction signal (low signal) from the input voltage detection circuit 21. The start/stop circuit 12 outputs the light emitting signal or the extinction signal while the start signal is being input, and outputs the stop signal while the stop signal is being input. In other words, the start/stop circuit 12 outputs the high (H) signal, which is the light emitting signal, only when the high signals are input from the regulator 11 and the input voltage detection circuit 21. The start/stop signal 12 outputs the low signal, which the extinction signal or the stop signal, when the low signal is input from at least one of the regulator 11 or the input voltage detection circuit 21. The signal output by the start/stop circuit 12 is input to the AND circuit 13.

A drain current detection circuit 18 is a comparator having a positive input terminal connected to the input terminal VJ to receive the low potential side voltage $V_J$, and the negative input terminal for receiving a detection reference voltage Vsn that becomes the reference. The drain current detection circuit 18 outputs the low (L) signal when the low potential side voltage $V_J$ is smaller than the detection reference voltage Vsn, and outputs the high (H) signal when the low potential side voltage $V_J$ is greater than or equal to the detection reference voltage Vsn. The output terminal of the drain current detection circuit 18 is connected to one of the input terminals of the AND circuit 17.

The output terminal of an ON-state blanking pulse generator 14 is connected to the other input terminal of the AND circuit 17. The AND circuit 17 outputs the high (H) signal only when the input signals are both high (H), otherwise outputs low (L) signal. The output of the AND circuit 17 is input to the OR circuit 16.

An oscillator 19 outputs a max duty signal MXDTY and a clock signal CLK. The OR circuit 16 receives the output signal of the AND circuit 17 and the inverted signal of the max duty signal MXDTY of the oscillator 19. The output terminal of the OR circuit 16 is connected to a reset signal terminal R of a RS flip-flop circuit 15. The clock signal CLK of the oscillator 19 is input to the set signal terminal S of the RS flip-flop circuit 15.

The input terminal of the AND circuit 13 is connected to the start/stop circuit 12, the output terminal of the max duty signal MXDTY of the oscillator 19, and the output terminal Q of the RS flip-flop circuit 15. The AND circuit 13 outputs the high (H) signal only when all the input signals are high (H), and outputs the low (L) signal when at least one of the input signals is low (L). The output terminal of the AND circuit 13 is connected to an output terminal GATE and the ON-state blanking pulse generator 14.

The ON-state blanking pulse generator 14 is connected to the connecting point of the AND circuit 13 and the control terminal of the switching element 10. The ON-state blanking pulse generator 14 inputs the output signal of the AND circuit 13 to output a low (L) signal for a certain time (for example, a few hundred nsec) from when the switching element 10 is switched from off to on. Otherwise, the ON-state blanking pulse generator 16 outputs the high (H) signal. The malfunction of on/off control of the switching element 10 due to ringing that occurs when the switching element 10 switches from off to on is prevented by inputting the output signal of the ON-state blanking pulse generator 14 and the output signal of the drain current detection circuit 18 to the AND circuit 17.

Figure 2:
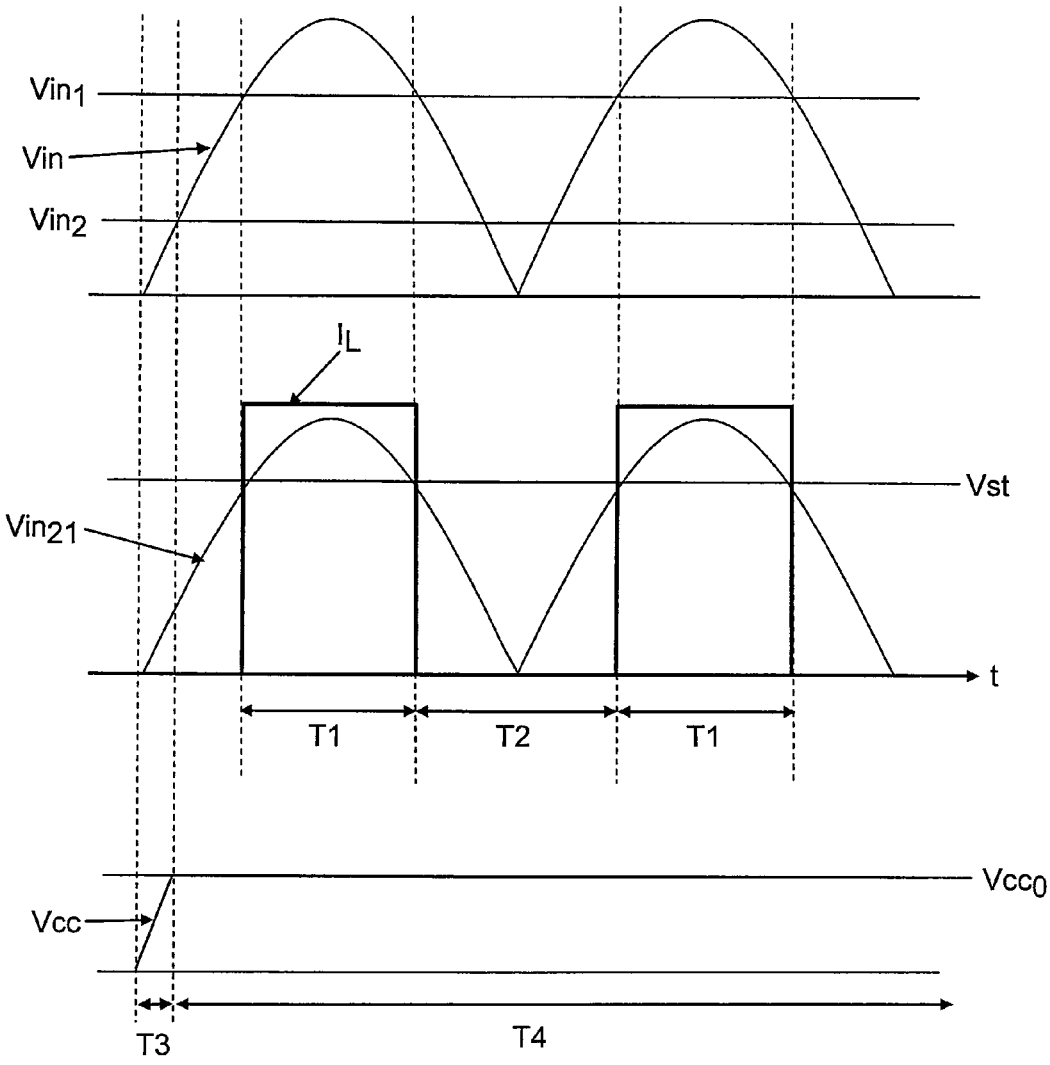
FIG. 2 is a diagram showing each voltage waveform of the light emitting diode driving apparatus of FIG. 1.
Figure 3:
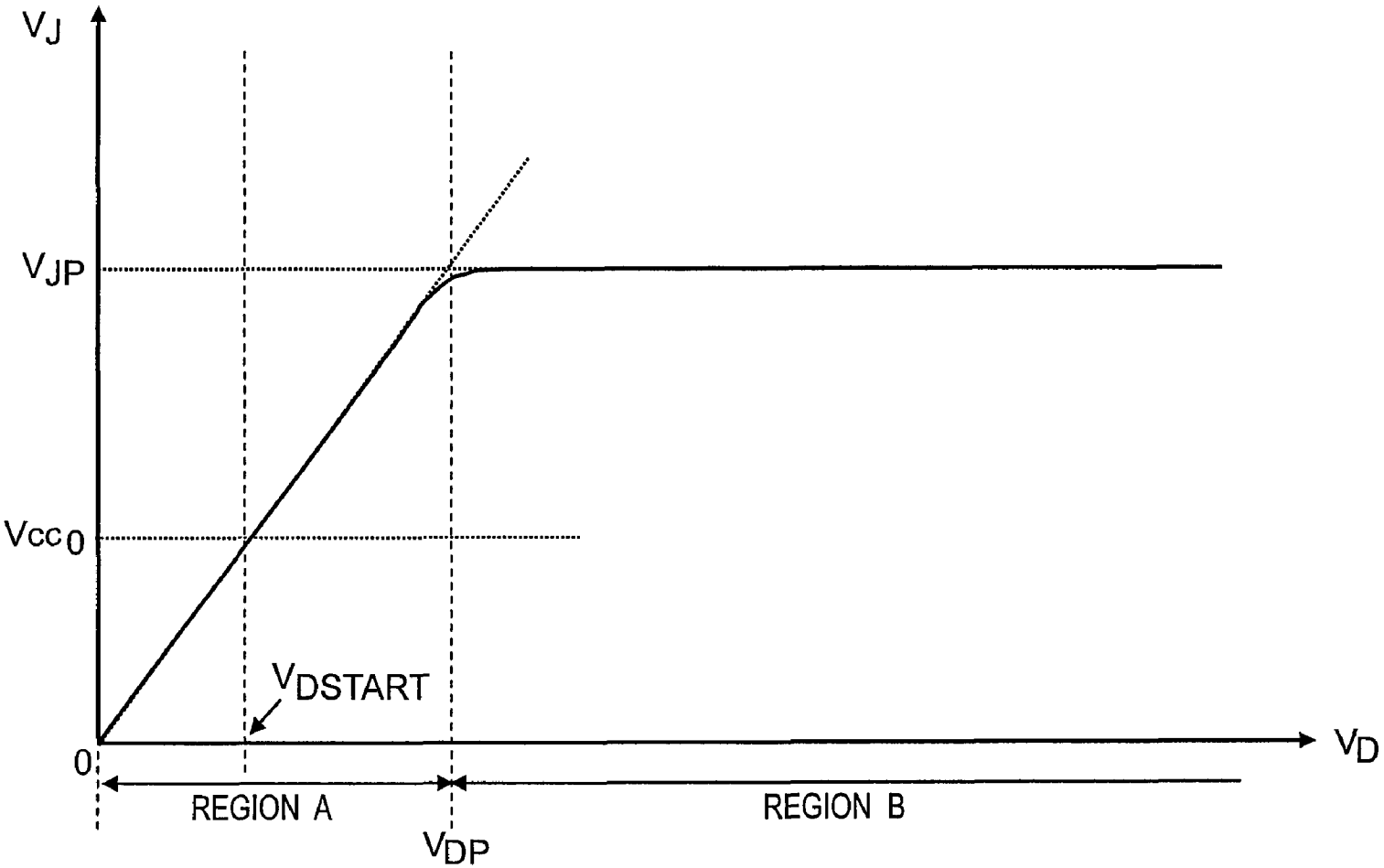
FIG. 3 is a diagram explaining the operation of a junction type FET.

The operation of the light emitting diode driving apparatus of the present embodiment configured as above will now be described using FIG. 2 and FIG. 3. FIG. 2 is a diagram showing the waveform of the full-wave rectified voltage Vin output by the rectifier circuit 2, the waveform of the current $I_L$ flowing into the light emitting diode 5, and the waveform of the reference voltage Vcc in the light emitting diode driving apparatus of the first embodiment of the present invention. The horizontal axis of FIG. 2 shows time t. FIG. 3 is a diagram showing the relationship of the high potential side voltage $V_D$ and the low potential side voltage $V_J$ in the junction type FET 9.

The full-wave rectifying current Vin output by the rectifier circuit 2 has a waveform obtained by full-wave rectifying the alternating-current voltage as shown in FIG. 2. The full-wave rectified voltage Vin is applied to the high potential side of the junction type FET 9 via the choke coil 3 and the light emitting diode 5, and thereby the high potential side voltage $V_D$ of the junction type FET 9 gradually rises. The low potential side voltage $V_J$ of the junction type FET 9 rises with rise in the high potential side voltage $V_D$, as shown in the region A of FIG. 3.

When the low potential side voltage $V_J$ rises, the reference voltage Vcc rises by the regulator 11, as shown in FIG. 2. During the stop period T3 until the reference voltage Vcc reaches the start voltage $Vcc_0$, the regulator 11 outputs the low signal of the stop signal to the start/stop circuit 12, and the on/off control of the switching element 10 is not performed.

The low potential side voltage $V_J$ reaches the start voltage $Vcc_0$ when the high potential side voltage $V_D$ shown in FIG. 3 reaches the voltage value $V_{DSTART}$. The regulator 11 then outputs the reference voltage Vcc of voltage value $Vcc_0$. As shown in the start period T4 of FIG. 2, the regulator 11 performs a control so that the outputting reference voltage Vcc is always at a constant voltage $Vcc_0$ even if the low potential side voltage $V_J$ becomes greater than or equal to the start voltage $Vcc_0$.

As shown in region B of FIG. 3, when the high potential side voltage $V_D$ rises and becomes greater than or equal to a predetermined value $V_{DP}$ ($V_D \geqq V_{DP}$), the low potential side voltage becomes a predetermined value $V_{JP}$ ($V_J = V_{JP}$) due to pinch off.

When the reference voltage Vcc becomes the start voltage $Vcc_0$, the internal circuits of the control circuit block 8 starts to operate. The oscillator 19 starts to output the max duty signal MXDTY and the clock signal CLK. The regulator 11 outputs the high signal of the start signal to the start/stop circuit 12. The control of the switching element 10 thereby starts. In other words, the start/stop circuit 12 controls the light emitting period T1 and the extinction period T2 of the light emitting diode 5 based on the light emitting signal or the extinction signal output from the input voltage detection circuit 21.

The comparator 20 of the input voltage detection circuit 21 outputs the high (H) signal as the light emitting signal to the start/stop circuit 12 when the voltage $Vin_{21}$ divided by the resistors 22 and 23 reaches the input reference voltages Vst (light emitting period T1). In response to the high (H) signal, the start/stop circuit 12 outputs the high (H) signal of the light emitting signal.

In the first embodiment, the voltage value ($Vin_1$) of the voltage Vin of when the voltage $Vin_{21}$ divided by the resistors 22 and 23 reaches the input reference voltage Vst is set to be higher than the voltage value ($Vin_2$) of the voltage Vin of when the low potential side voltage $V_J$ reaches the voltage $Vcc_0$.

The comparator 20 in the input voltage detection circuit 21 outputs the low (L) signal of the extinction signal to the start/stop circuit 12 when the voltage $Vin_{21}$ divided by the resistors 22 and 23 is below the input reference voltage Vst (extinction period T2). In response to the low (L) signal, the start/stop circuit 12 outputs the low signal (L) of the extinction signal. The control of the switching element 10 is thereby stopped. That is, the switching element 10 is maintained in the OFF-state, and the emission of the light emitting diode 5 is quenched.

That is, an intermittent on/off control of the switching element 10 is executed and the light emitting diode 5 emits light during the light emitting period T1 in which the voltage $Vin_{21}$ is greater than or equal to the input reference voltage Vst, and on/off control of the switching element 10 is stopped and the emission of the light emitting diode 5 is quenched in the extinction period T2 in which the voltage $Vin_{21}$ is less than or equal to the input reference voltage Vst. The constant current $I_L$ flows in the light emitting diode 5 in the light emitting period T1 but does not flow in the extinction period T2.

Figure 4:
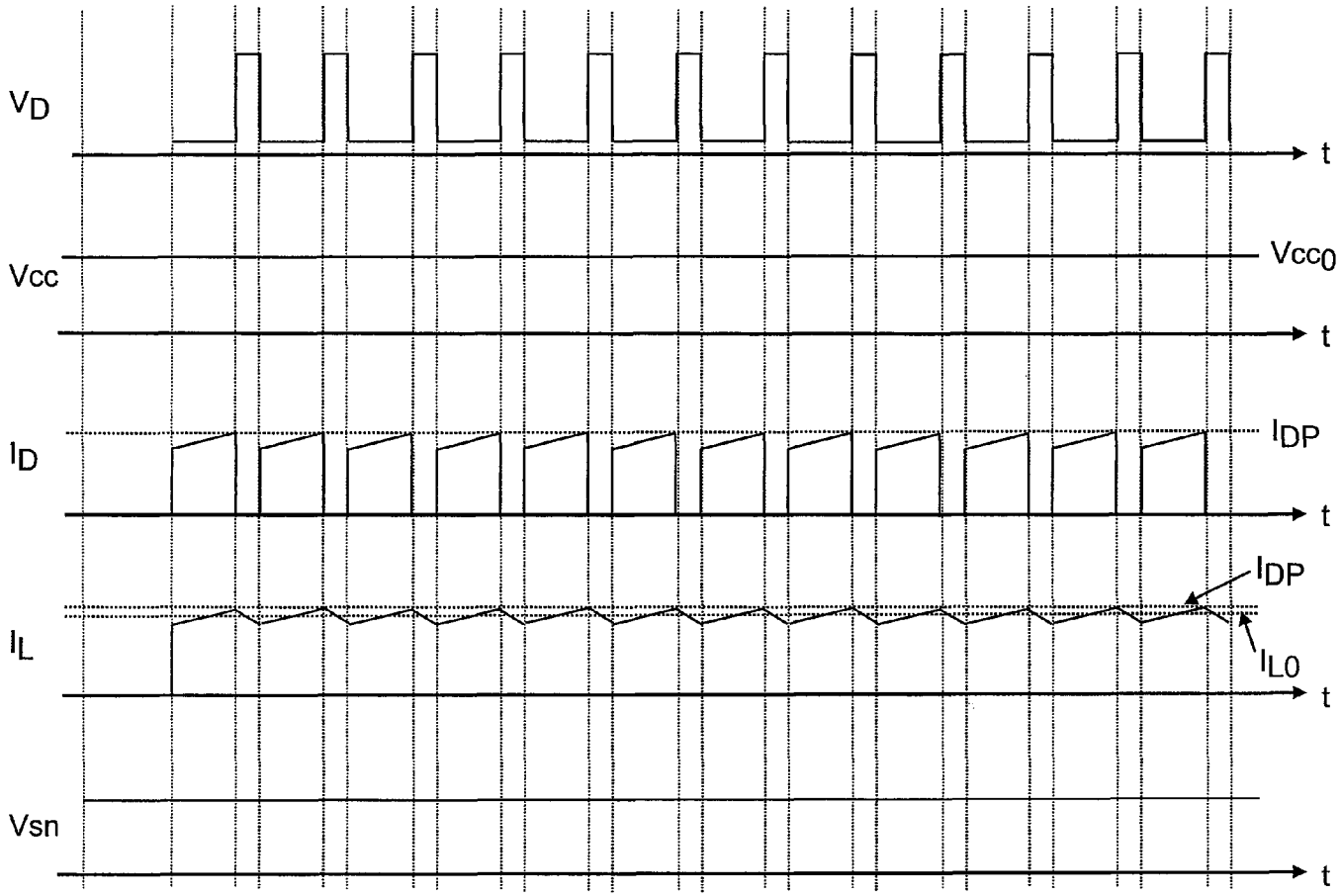
FIG. 4 is a diagram showing a constant current output operation of the light emitting diode driving apparatus of FIG. 1.

The constant current output operation by the on/off control of the light emitting diode driving apparatus of the first embodiment of the present invention will now be described using FIG. 1 and FIG. 4. FIG. 4 is an operation waveform chart in the light emitting period T1 of FIG. 2. The horizontal axis of FIG. 4 indicates time t. During the light emitting period T1 of FIG. 2, the AND circuit 13 receives the high signal of the light emitting signal from the start/stop circuit 12 to output the control signal of high level or low level based on the max duty signal MXDTY and the output signal of the RS flip-flop 15.

The oscillating frequency of the switching element 10 and the MAX on-duty are respectively defined by the clock signal CLK and the max duty signal MXDTY of the oscillator 19. The current $I_D$ flowing through the switching element 10 is detected by comparing the ON-voltage (i.e., low potential side voltage $V_J$ when switching element 10 is turned ON) with the detection reference voltage Vsn of the drain current detection circuit 18.

When the low potential side voltage $V_J$ of when the switching element 10 is turned ON reaches the voltage value of the detection reference voltage Vsn, the drain current detection circuit 18 outputs a signal of high (H) level. The OR circuit 16 receives the signal of high (H) level to output the signal of high (H) level, and thereby the signal of high (H) level is input to the reset signal terminal R of the RS flip-flop 15. The RS flip-flop 15 is reset and output the signal of low (L) level to the AND circuit 13. The switching element 10 is turned off when the AND circuit 13 outputs the signal of low (L) level.

The switching element 10 is turned on when the clock signal CLK of the oscillator 19 is input to the set signal terminal S of the RS flip-flop 15.

That is, the on-duty of the switching element 10 is defined by the inverted signal of the MAX DUTY signal of the oscillator 19 and the output signal of the OR circuit 16 which receives the output signal of the drain current detection circuit 18.

Therefore, when an intermittent on/off control of the switching element 10 by the control circuit block 8 is performed in the light emitting period T1 of FIG. 2, the current $I_D$ flowing through the switching element 10 becomes as shown in FIG. 4. When the switching element 10 is in the ON-state, the current having $I_D = I_{DP}$ as the peak flows in the direction of choke coil 3→light emitting diode 5→switching element 10. When the switching element 10 is in the OFF-state, the current flows in the closed loop of choke coil 3→light emitting diode 5→diode 4. The current flowing through the choke coil 3 (i.e., current flowing in the light emitting diode 5) has a waveform shown in $I_L$ of FIG. 4, where the average current of the current flowing in the light emitting diode 5 becomes $I_{LO}$ of FIG. 4.

Generally, the white light emitting diode includes a blue light emitting diode for emitting a blue color by the driving current, and a fluorescent material of YAG series that converts blue to yellow. The white light emitting diodes emits white light when the fluorescent material emits fluorescent light by the blue color of the blue light emitting diode. In such white light emitting diode, the forward current value flowing in the white light emitting diode, and the chromaticity and luminosity of the white light emitting diode are correlated. That is, when the forward current value increases, the relative luminosity increases, and furthermore, the chromaticity changes. Thus, in order to adjust the luminosity with the chromaticity constant, the forward current value of the light emitting diode must be made constant, and the period in which the current flows in a constant period must be adjusted.

The forward current value of the current $I_L$ flowing in the light emitting diode 5 is easily adjusted by changing the detection reference voltage Vsn of the drain current detection circuit 18 by using the light emitting diode driving apparatus of the present embodiment. The forward current value of the average current $I_{LO}$ flowing in the light emitting diode 5 can be made constant by using the light emitting diode driving apparatus of the present embodiment.

The light emitting period T1 in which the current flows in the light emitting diode can be easily adjusted by changing the input reference voltage Vst. If a commercial battery is used for the alternating power supply 1, the light emitting period T1 and the extinction period T2 can be easily adjusted at a doubling period (100 Hz/120 Hz), and the chromaticity and the luminosity of the white light emitting diode can be easily adjusted.

Furthermore, the following advantages are obtained when the light emitting diode driving apparatus of the present embodiment is used. The light emitting diode driving apparatus of the first embodiment of the present invention does not have power loss in time of start-up since a resistor for power supply is not necessary. Generally, the power supply to the light emitting diode driving semiconductor circuit is performed directly via the resistor from the input voltage (high voltage). Such power supply is not only performed in start/stop, but is also performed in a similar manner during normal operation, and thus power loss at the resistor occurs. However, such resistor is not necessary according to the configuration of the present embodiment.

The current flowing through the switching element 10 is detected by detecting the ON-voltage of the switching element 10 by the drain current detection circuit 18, and thus the detection resistor for current detection as in the prior art is not necessary, and power loss caused by the detection resistor does not occur.

The voltage from low voltage to high voltage can be input as input power supply by using the junction type FET 9. A compact light emitting diode driving apparatus having reduced number of components and obtaining stable light emitting luminance is thereby achieved.

In FIG. 1, further miniaturization of the light emitting diode driving apparatus is achieved by realizing a light emitting diode driving semiconductor circuit 6 in which the switching element block 7 and the control block 8 are formed on the same substrate. This is the same for the subsequent embodiments described below.

Furthermore, the full-wave rectifier circuit 2 is used as a means for rectifying the alternating-current voltage in FIG. 1, but similar effects are obviously obtained by using a half-wave rectifier circuit. This is the same for the subsequent embodiments described below.

Although not shown in FIG. 1, a clamp circuit such as a Zener diode may be connected in parallel to the high potential side and the low potential side of the switching element block 7 such as the high potential side terminal DRN and the low potential side terminal GND-SRCE. In the intermittent on/off control of the switching element 10 by the control circuit block 8, the high potential side voltage $V_D$ of the switching element block 7 becomes a voltage exceeding the withstand voltage of the switching element 10 due to ringing caused by wiring capacitance and wiring inductance when the switching element 10 turns from on to off, which may break the switching element 10. In such case, the clamp circuit having a clamp voltage lower than the withstand voltage of the switching element 10 is connected in parallel to the switching element block 7, so that the voltage $V_D$ of the high potential side terminal DRN of the switching element block 7 is clamped at the clamp voltage, and the breakage of the switching element 10 can be prevented. Thus, the light emitting diode driving apparatus having higher safety is realized. Similar effects are obtained by adding the clamp circuit in the following embodiments as well.

In the transition state of when the switching element 10 turns from the OFF-state to the ON-state, the power loss becomes larger if the reverse recovery time (Trr) of the diode 4 is slow, and thus the reverse recovery time (Trr) of the diode 4 of the first embodiment of the present invention is set to less than or equal to 100 nsec.

Second Embodiment

Figure 5:
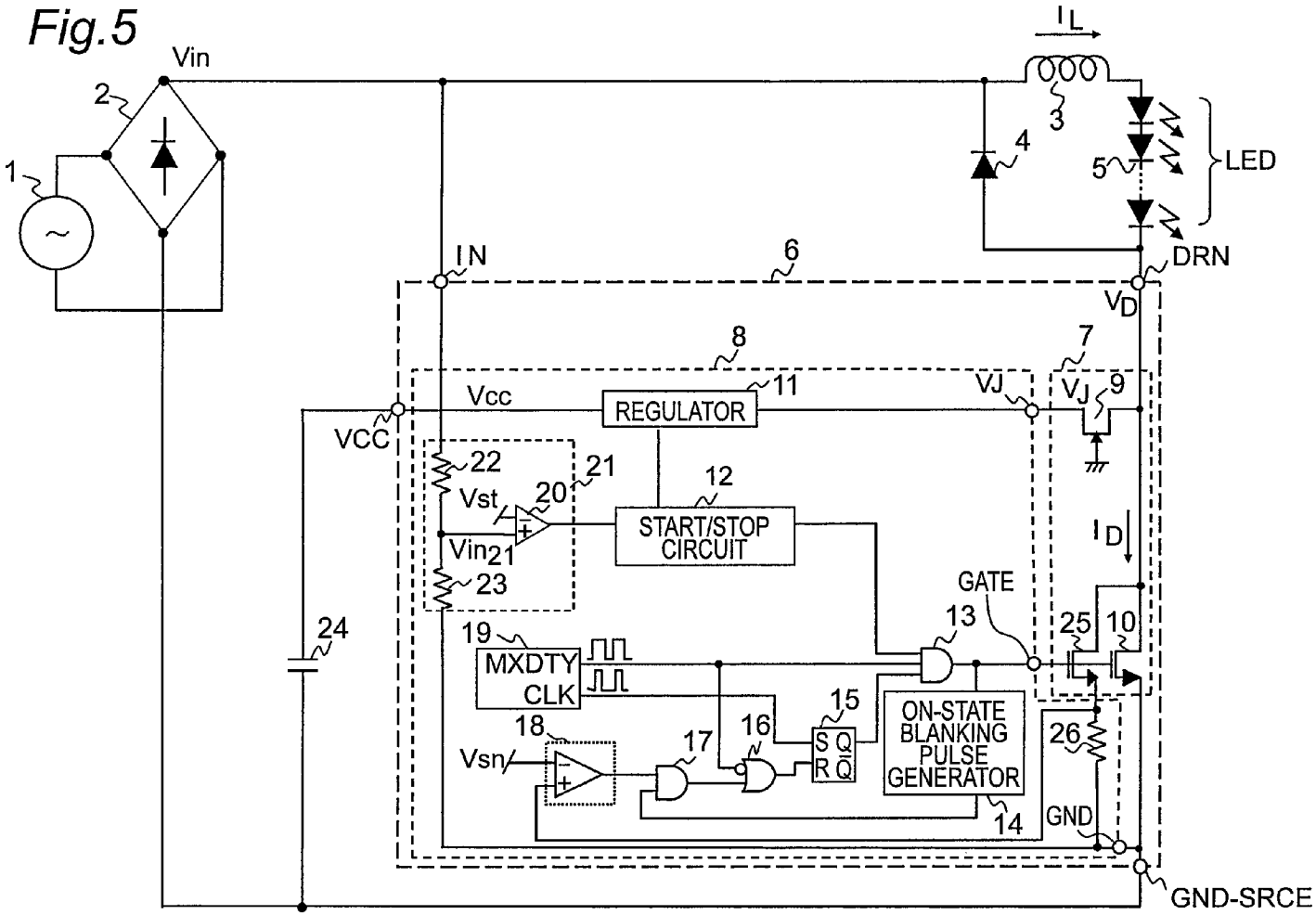
FIG. 5 is a circuit diagram showing a light emitting diode driving apparatus of a second embodiment of the present invention.

A light emitting diode driving semiconductor circuit and a light emitting diode driving apparatus of the second embodiment of the present invention will now be described using FIG. 5. FIG. 5 is a view showing the light emitting diode driving semiconductor circuit and the light emitting diode driving apparatus of the second embodiment of the present invention. The second embodiment of the present invention shown in FIG. 5 differs from the first embodiment shown in FIG. 1 regarding the connection of the junction type FET 9 of the switching block 7, and in that a switching element 25 (second switching element) and a resistor 26 are added. Other configurations are the same as that of FIG. 1.

The junction type FET 9 of the second embodiment has the high potential side connected to a connecting point of the high potential side terminal DRN and the switching element 10, and the low potential side connected to the input terminal VJ of the control circuit block 8. This configuration is suitable when configuring the junction type FET 9 with a package different from the switching element 10.

The light emitting diode driving semiconductor circuit 6 of the second embodiment connects the switching element 25 (N-type MOSFET), into which the current smaller than the current flowing through the switching element 10 and having a constant current ratio flows, in parallel to the switching element 10. The high potential side of the switching element 25 is connected to the high potential side of the switching element 10. The control terminal of the switching element 25 is connected to the output terminal GATE of the control circuit block 8 in common with the control terminal of the switching element 10. The low potential side of the switching element 25 is connected to one end of the resistor 26. The other end of the resistor 26 is connected to the ground terminal GND. The drain current detection circuit 18 of the second embodiment detects the current flowing through the switching element 25 by detecting the voltage of both ends of the resistor 26, and compares the detected voltage with the detection reference voltage Vsn.

As in the first embodiment, the current $I_D$ cannot be accurately detected for a constant time (generally a few hundred nsec) from when the switching element 10 is turned from the OFF-state to the ON-state in a method of detecting the current $I_D$ using the ON-voltage of the switching element 10. In the second embodiment, however, the current $I_D$ can be accurately detected even immediately after the switching element 10 is turned from the OFF-state to the ON-state by comparing the voltage determined by (current flowing to resistor 26×resistance value) and the detection reference voltage Vsn. The current detection of the switching element 10 becomes possible with reduced power loss since large current is not directly detected by the resistor.

Third Embodiment

Figure 6:
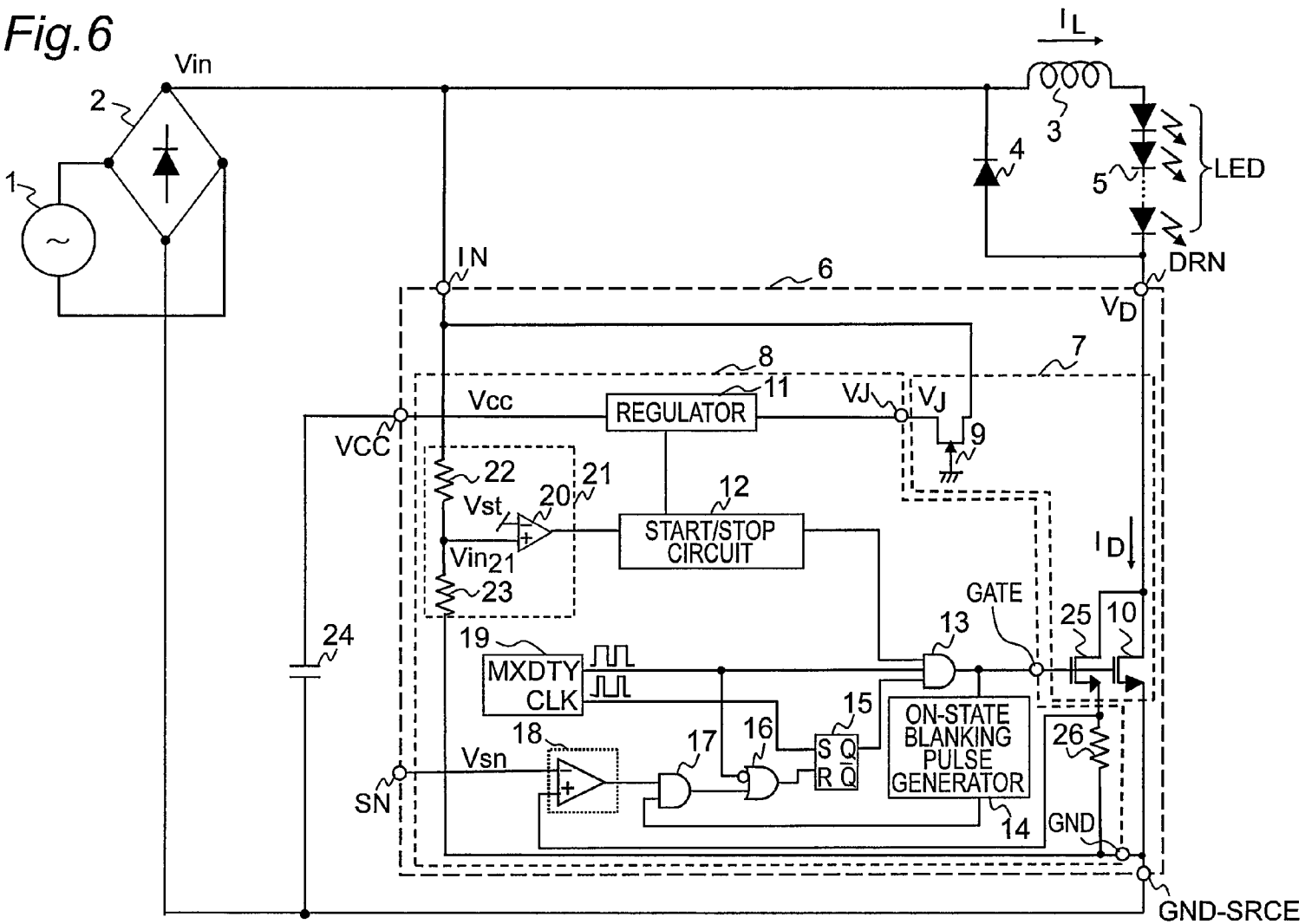
FIG. 6 is a circuit diagram showing a light emitting diode driving apparatus of a third embodiment of the present invention.

A light emitting diode driving semiconductor circuit and a light emitting diode driving apparatus according to the third embodiment of the present invention will now be described using FIG. 6 and FIG. 7. FIG. 6 is a view showing the light emitting diode driving semiconductor circuit and the light emitting diode driving apparatus of the third embodiment of the present invention. The third embodiment of the present invention shown in FIG. 6 differs from the second embodiment shown in FIG. 5 regarding the connection of the junction type FET 9 in the switching element block 7 and in that the terminal SN determining the detection reference voltage Vsn of the drain current detection circuit 18 is an external terminal. Other circuit configurations are the same as that of the second embodiment.

The high potential side of the junction type FET 9 in the switching element block 7 is connected to the rectified voltage terminal IN, and the low potential side is connected to the input terminal VJ of the control circuit block 8 in the third embodiment of the present invention.

When the junction type FET 9 is connected as in FIG. 1 of the first embodiment or in FIG. 5 of the second embodiment, the power supply to the light emitting diode driving semiconductor circuit 8 while the operation of the switching element 10 is stopped (in OFF-state) is performed through a route of full-wave rectified voltage Vin→coil 3→light emitting diode 5→high potential side terminal DRN→junction type FET 9→regulator 11→reference voltage terminal VCC, and thus the light emitting diode 5 emits a very weak light.

In the light emitting diode driving apparatus of the third embodiment, the power supply to the light emitting diode driving semiconductor circuit 8 is performed through a route of full-wave rectified voltage Vin→rectified voltage terminal IN→junction type FET 9→regulator 11→4 reference voltage terminal VCC. In this case, the light emitting diode 5 is not passed, and thus the advantage in that the light emitting diode 5 does not emit a very weak light while the operation of the switching element 10 is stopped is obtained.

Start and stop of the light emitting diode driving apparatus of the third embodiment of the present invention shown in FIG. 6 is basically the same as in the light emitting diode driving apparatus of the first embodiment of the present invention.

In the third embodiment, the detection reference voltage Vsn of the drain current detection circuit 18 can be varied by a voltage input to the external detection terminal SN. The operation of the light emitting diode driving apparatus of the third embodiment of the present invention will be described below using FIG. 7. If the detection reference voltage Vsn input to the external detection terminal SN is gradually lowered in three stages as shown in FIG. 7, the detection level of the drain current $I_D$ also gradually lowers in three stages, and thus the current that flows through the switching element 10 also gradually lowers in three stages. The PWM controlled current as shown in $I_D$ of FIG. 7 thus flows through the switching element 10, and the current flowing through the choke coil 3 (i.e., current flowing in the light emitting diode 5) becomes $I_L$ of FIG. 7. The average current of the light emitting diode 5 becomes $I_{LO}$ in FIG. 7. That is, the average current of the light emitting diode 5 changes by the detection reference voltage Vsn input to the external detection terminal SN.

The operation of the drain current detection circuit 18 has been described on the assumption that the average current of the light emitting diode 5 changes proportional to the change in the detection reference voltage Vsn in the third embodiment, but may operate so that the average current of the light emitting diode 5 changes inversely proportional to the change in the detection reference voltage Vsn of the drain current detection circuit 18 (This is the same for subsequent embodiments).

In case that the light emitting diode driving semiconductor circuit and the light emitting diode driving apparatus described above are used, the following effects are also obtained in addition to the effects described in the second embodiment of the present invention. The light emitting diode 5 is prevented from emitting a very weak light while the operation of the switching element 10 is stopped (in OFF-state).

Since the terminal determining the detection reference voltage Vsn of the drain current detection circuit 18 appears as the external detection terminal SN, the forward current value of the light emitting diode can be easily adjusted from the outside. In other words, the chromaticity of the white light emitting diode is easily adjusted.

Fourth Embodiment

Figure 8:
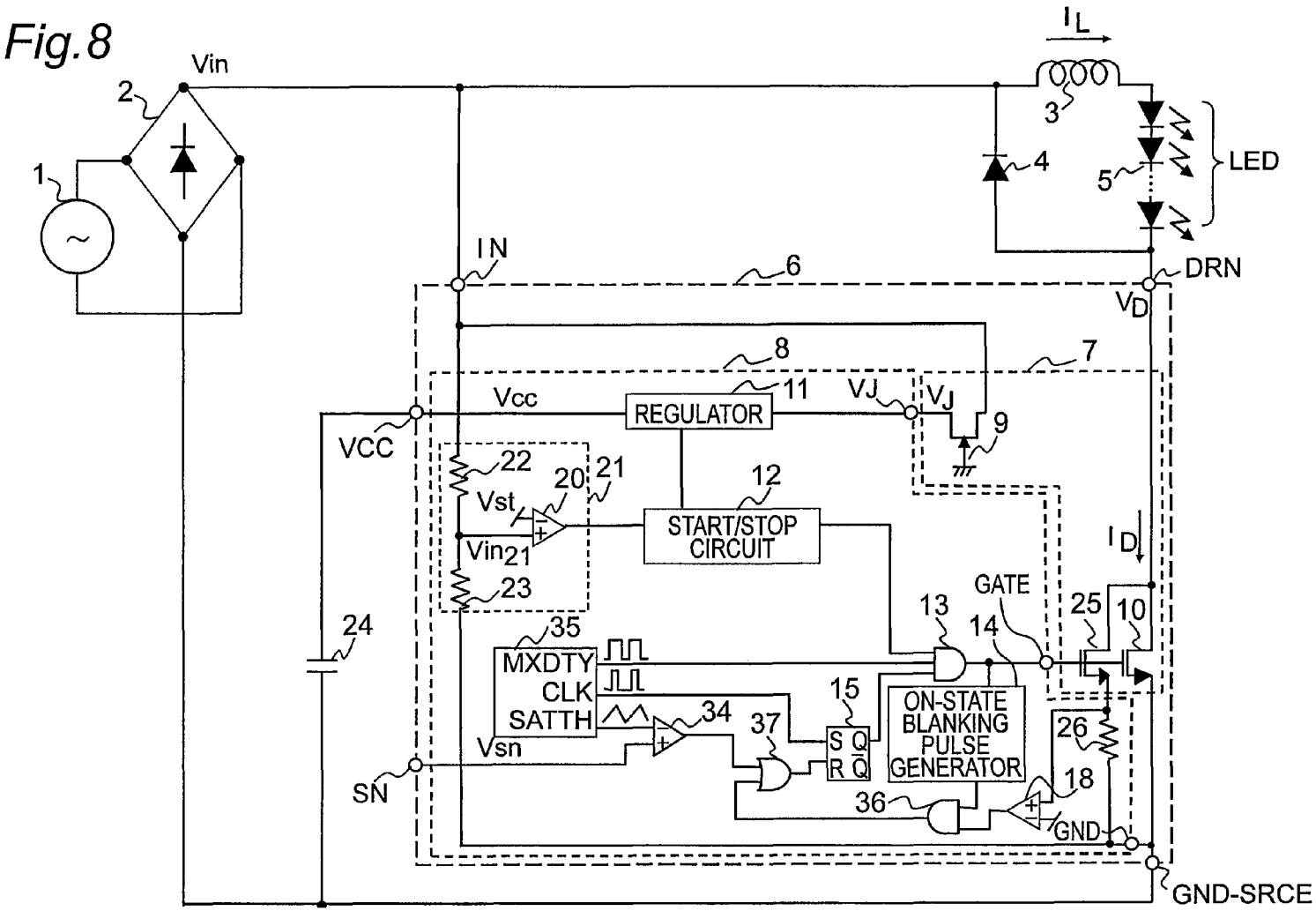
FIG. 8 is a circuit diagram showing a light emitting diode driving apparatus of a fourth embodiment of the present invention.

A light emitting diode driving semiconductor circuit and a light emitting diode driving apparatus of the fourth embodiment of the present invention will now be described using FIG. 8. FIG. 8 is a view showing a light emitting diode driving semiconductor circuit and a light emitting diode driving apparatus of the fourth embodiment of the present invention. The fourth embodiment of the present invention shown in FIG. 8 differs from the third embodiment of the present invention shown in FIG. 6 regarding the configuration of the control circuit block 8 in the following aspects.

In the fourth embodiment, although the drain current detection circuit 18 detects the current flowing through the switching element 25 by detecting the voltage at both ends of the resistor 26, the voltage input to the negative input terminal of the drain current detection circuit 18 is a constant voltage and not a detection reference voltage Vsn. That is, the maximum value of the current flowing through the switching element 10 is always constant.

An oscillator 35 of the present embodiment outputs a sawtooth wave signal SATTH. A comparator 34 compares the sawtooth wave signal SATTH and the detection reference voltage Vsn input to the external detection terminal SN. The output signal of the comparator 34 is input to the OR circuit 37. In addition to the output signal of the comparator 34, the output signal of the AND circuit 36 is input to the OR circuit 37. The output signal of the OR circuit 37 is input to the reset signal terminal R of the RS flip-flop circuit 15. According to such configuration, the on-duty of the switching element 10 changes by the detection reference voltage Vsn input to the external detection terminal SN. In other words, the switching element 10 is PWM controlled.

Figure 7:
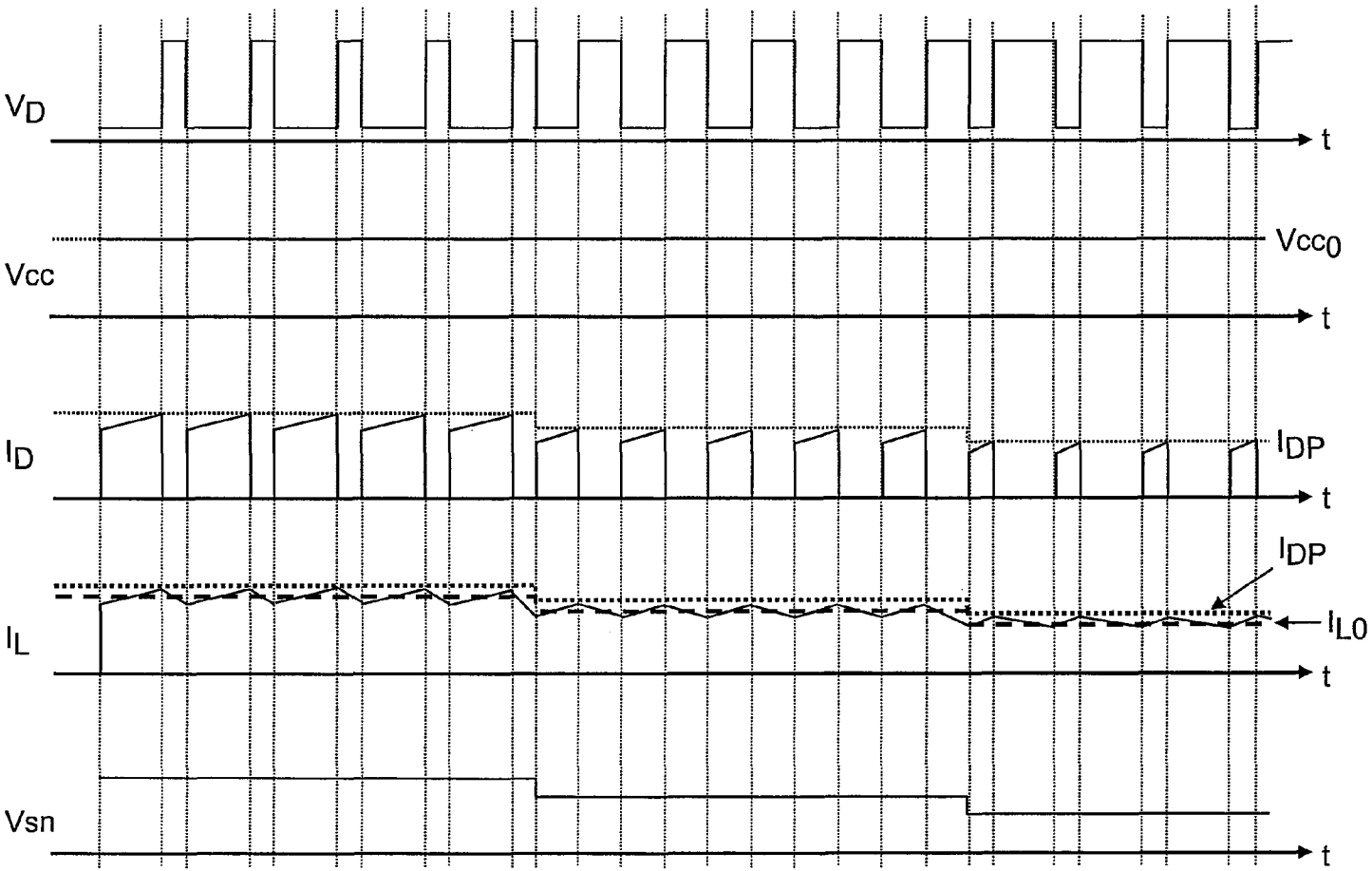
FIG. 7 is a diagram showing a constant current output operation of the light emitting diode driving apparatus of FIG. 6.

In case that the light emitting diode driving semiconductor circuit and the light emitting diode driving apparatus described above are used, the configuration may be different from that of the third embodiment shown in FIG. 6, but the current and voltage waveform of each terminal is as shown in FIG. 7, and thus effects similar to the third embodiment are obtained.

Fifth Embodiment

Figure 9:
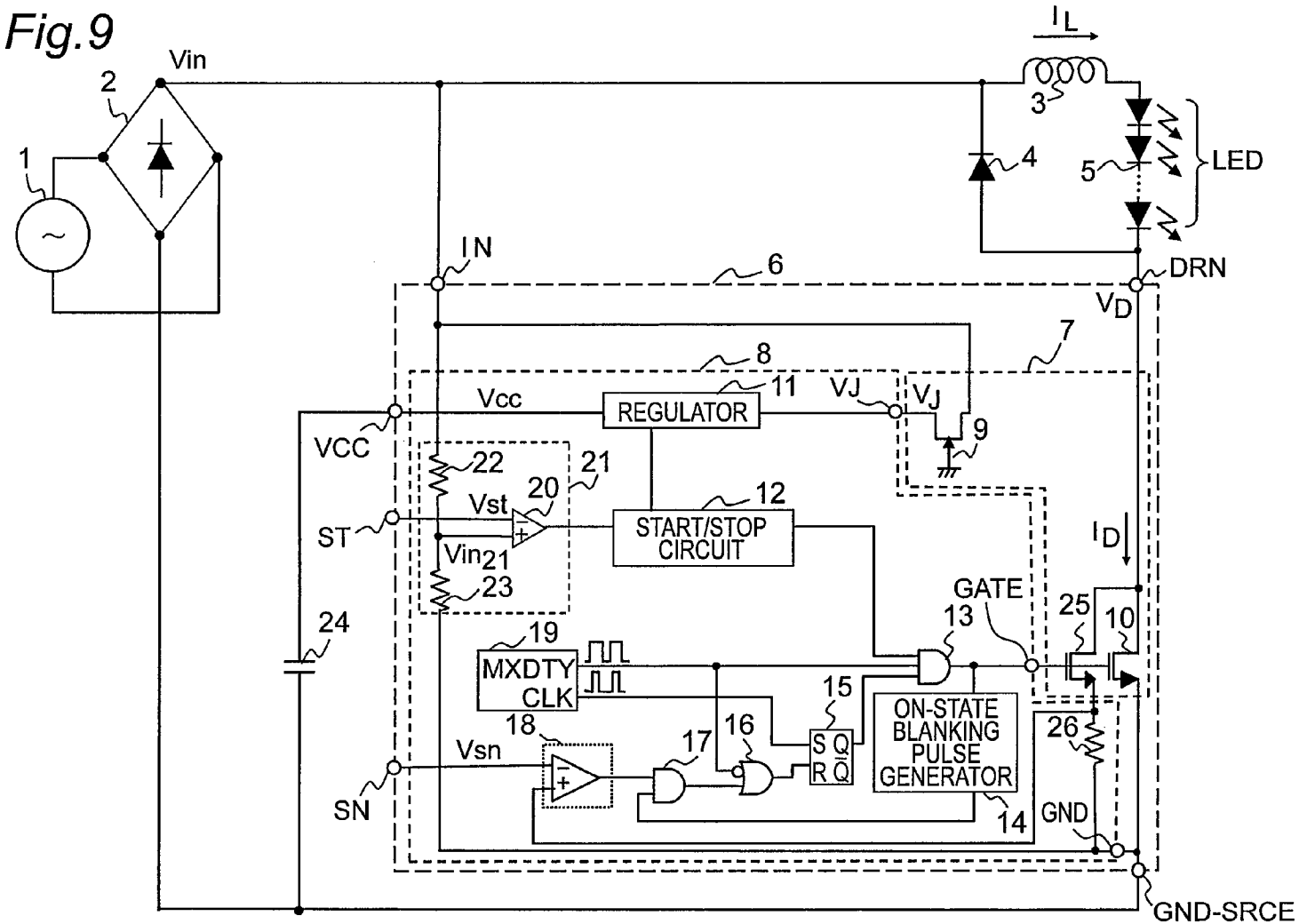
FIG. 9 is a circuit diagram showing a light emitting diode driving apparatus of a fifth embodiment of the present invention.

A light emitting diode driving semiconductor circuit and a light emitting diode driving apparatus of the fifth embodiment of the present invention will now be described using FIG. 9. FIG. 9 is a view showing the light emitting diode driving semiconductor circuit and the light emitting diode driving apparatus of the fifth embodiment of the present invention. The fifth embodiment of the present invention shown in FIG. 9 differs from the third embodiment of the present invention shown in FIG. 6 regarding the configuration of the input voltage detection circuit 21 in the following aspects. The light emitting diode driving semiconductor circuit 6 has an external input terminal ST, and the input reference voltage Vst input to the negative input terminal of the comparator 20 of the input voltage detection circuit 21 is input from the external input terminal ST. Therefore, the input reference voltage Vst may be varied.

The voltage for starting or stopping the on/off control of the switching element 10 can be easily adjusted by providing the terminal determining the input reference voltage Vst of the input voltage detection circuit 21 as the external input terminal ST. If commercial power supply is used as the alternating-current power supply 1, the light emitting period and the extinction period are easily adjusted in the doubling period (100 Hz/120 Hz), and the light emitting diode driving apparatus in which the chromaticity and luminosity of the white light emitting diode can be easily adjusted is realized.

Sixth Embodiment

Figure 10:
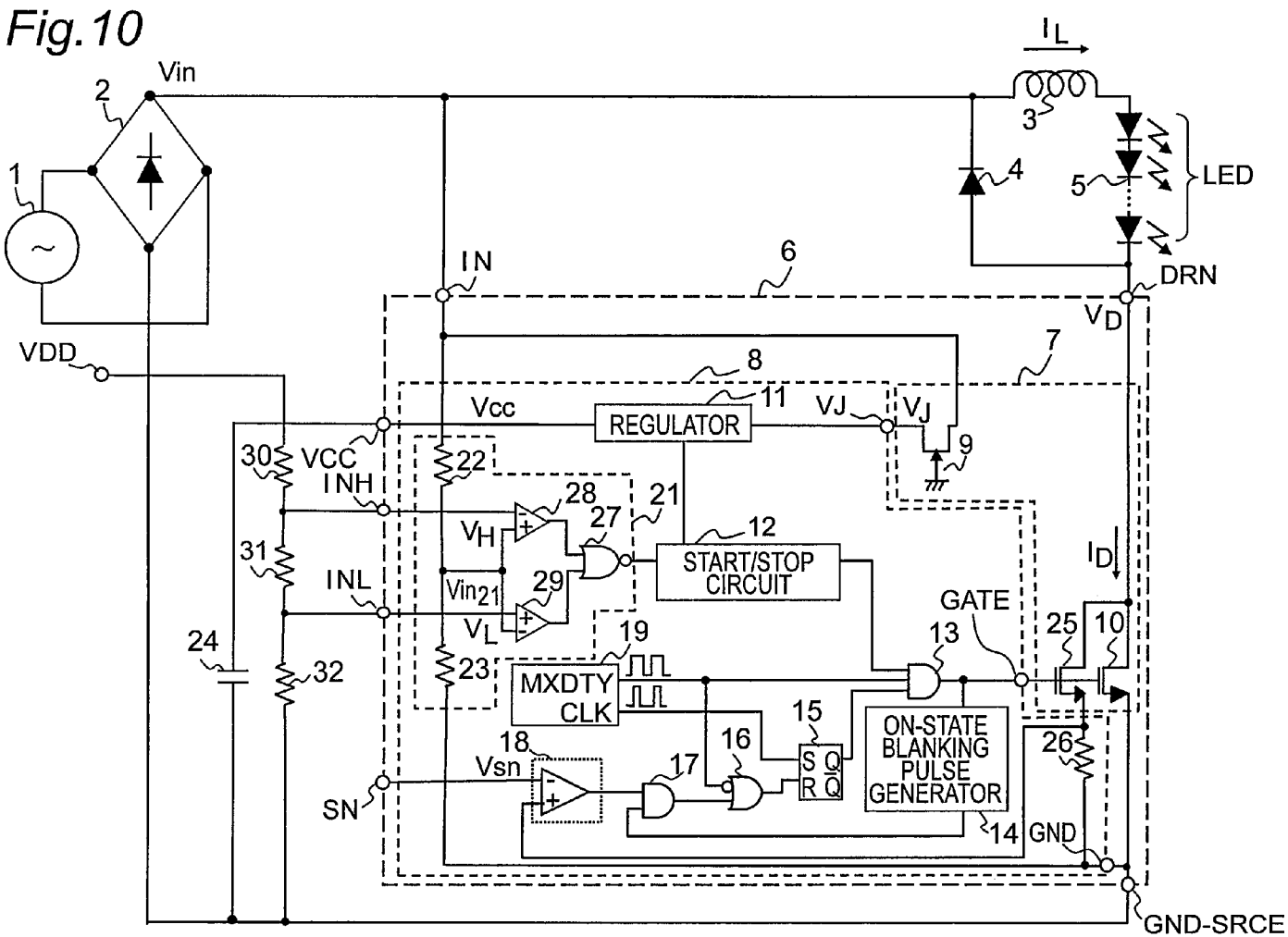
FIG. 10 is a circuit diagram showing a light emitting diode driving apparatus of a sixth embodiment of the present invention.

A light emitting diode driving semiconductor circuit and a light emitting diode driving apparatus of the sixth embodiment of the present invention will now be described using FIG. 10 and FIG. 11. FIG. 10 is a view showing the light emitting diode driving semiconductor circuit and the light emitting diode driving apparatus of the sixth embodiment of the present invention. The sixth embodiment of the present invention shown in FIG. 10 differs from the fifth embodiment of the present invention shown in FIG. 9 regarding the configuration of the input voltage detection circuit 21 in the following aspects.

The input voltage detection circuit 21 of the sixth embodiment includes by two resistors 22 and 23 connected in series between the rectified voltage terminal IN and the ground terminal GND of the control circuit block, a first comparator 29 having a negative input terminal for inputting the direct-current voltage $Vin_{21}$ divided by the resistor 22 and the resistor 23, a second comparator 28 having a positive input terminal for inputting the direct-current voltage $Vin_{21}$ divided by the resistor 22 and the resistor 23, and a NOR circuit 27 connected to the output terminals of the first comparator 29 and the second comparator 28. The output of the NOR circuit 27 is input to the start/stop circuit 12.

The positive input terminal of the first comparator 29 is connected to a low (L) level input terminal INL (first external input terminal) of the external terminal of the light emitting diode driving semiconductor device 6. The negative input terminal of the second comparator 28 is connected to a high (H) level input terminal INH (second external input terminal) of the external terminal of the light emitting diode driving semiconductor device 6. The extinction voltage $V_H$ and the light emitting voltage $V_L$ obtained by dividing the voltage input from the terminal VDD by three resistors 30, 31 and 32 which are connected in series are input to the high level input terminal INH and the low level input terminal INL, respectively. Here, $V_H > V_L$ is met.

The operation of the light emitting diode driving semiconductor circuit and the light emitting diode driving apparatus of the sixth embodiment of the present invention will now be described using FIG. 10 and FIG. 11. FIG. 11 is a diagram showing each voltage waveform of the light emitting diode driving apparatus of FIG. 10. When the direct-current voltage $Vin_{21}$ divided by two resistors 22 and 23 reaches the light emitting voltage $V_L$, the first comparator 29 outputs the low (L) signal. Since the divided direct-current voltage $Vin_{21}$ is lower than the extinction voltage $V_H$, the second comparator 28 outputs the low (L) signal. The NOR circuit 27 receives the low signal and the low signal and outputs the high (H) signal of the light emitting signal. The start/stop circuit 12 receives the high signal to output the high (H) signal of the light emitting signal to the AND circuit 13. The intermittent on/off control of the switching element 10 by the control circuit block 8 thereby starts, and the light emitting diode 5 emits light (light emitting period T1 of FIG. 11).

When the direct-current voltage $Vin_{21}$ divided by two resistors 22 and 23 reaches the extinction voltage $V_H$, the second comparator 28 outputs the high (H) signal. Since the divided direct-current voltage $Vin_{21}$ is higher than the light emitting voltage $V_L$, the comparator 29 outputs the low (L) signal. The NOR circuit 27 receives the high (H) signal and the low (L) signal, and thus outputs the low (L) signal of the extinction signal. The start/stop circuit 12 receives the low (L) signal and outputs the low signal of the extinction signal to the AND circuit 13. The control circuit block 8 stops the control of the switching element 10, that is the switching element 10 is maintained in the OFF-state, and the emission of the light emitting diode 5 is quenched (extinction period T2 of FIG. 11).

Figure 11:
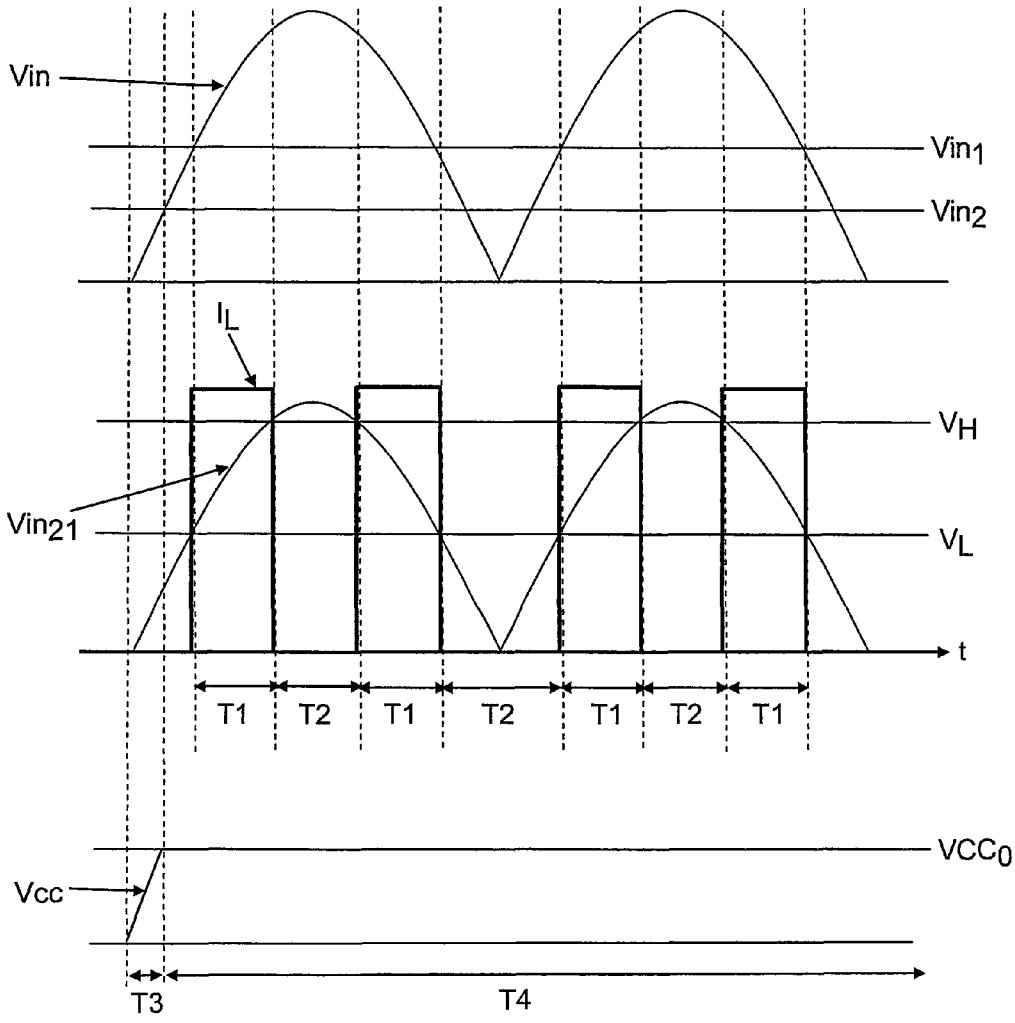
FIG. 11 is a diagram showing each voltage waveform of the light emitting diode driving apparatus of FIG. 10.

In other words, the light emitting diode driving apparatus of the sixth embodiment performs intermittent on/off control of the switching element 10 in the light emitting period T1 in which the divided direct-current voltage $Vin_{21}$ is greater than or equal to the light emitting voltage $V_L$ and smaller than or equal to the extinction voltage $V_H$, as shown in FIG. 11. The light emitting diode 5 emits light in the light emitting period T1. In the extinction period T2 in which the divided direct-current voltage $Vin_{21}$ is greater than the extinction voltage $V_H$ or smaller than the light emitting voltage $V_L$, the control of the switching element 10 is stopped and maintained in the OFF-state, and thus the emission of the light emitting diode is quenched.

In the sixth embodiment, the values of the extinction voltage $V_H$ and the light emitting voltage $V_L$ are determined by a divided voltage with three resistors 30, 31 and 32 connected in series, but are not limited thereto. A signal maintaining the relationship of $V_H > V_L$, and achieving a relationship in which the divided direct-current voltage $Vin_{21}$ changes from a voltage lower than the light emitting voltage $V_L$ to the voltage higher than the extinction voltage $V_H$ with respect to the change in the full-wave rectified voltage Vin simply needs to be obtained.

According to the above configuration, a light emitting diode driving apparatus that allows a more complex luminosity adjustment and that has high power conversion efficiency is realized since the levels of the light emitting voltage and the extinction voltage during one period of the full-wave rectified voltage Vin can be individually set.

Seventh Embodiment

Figure 12:
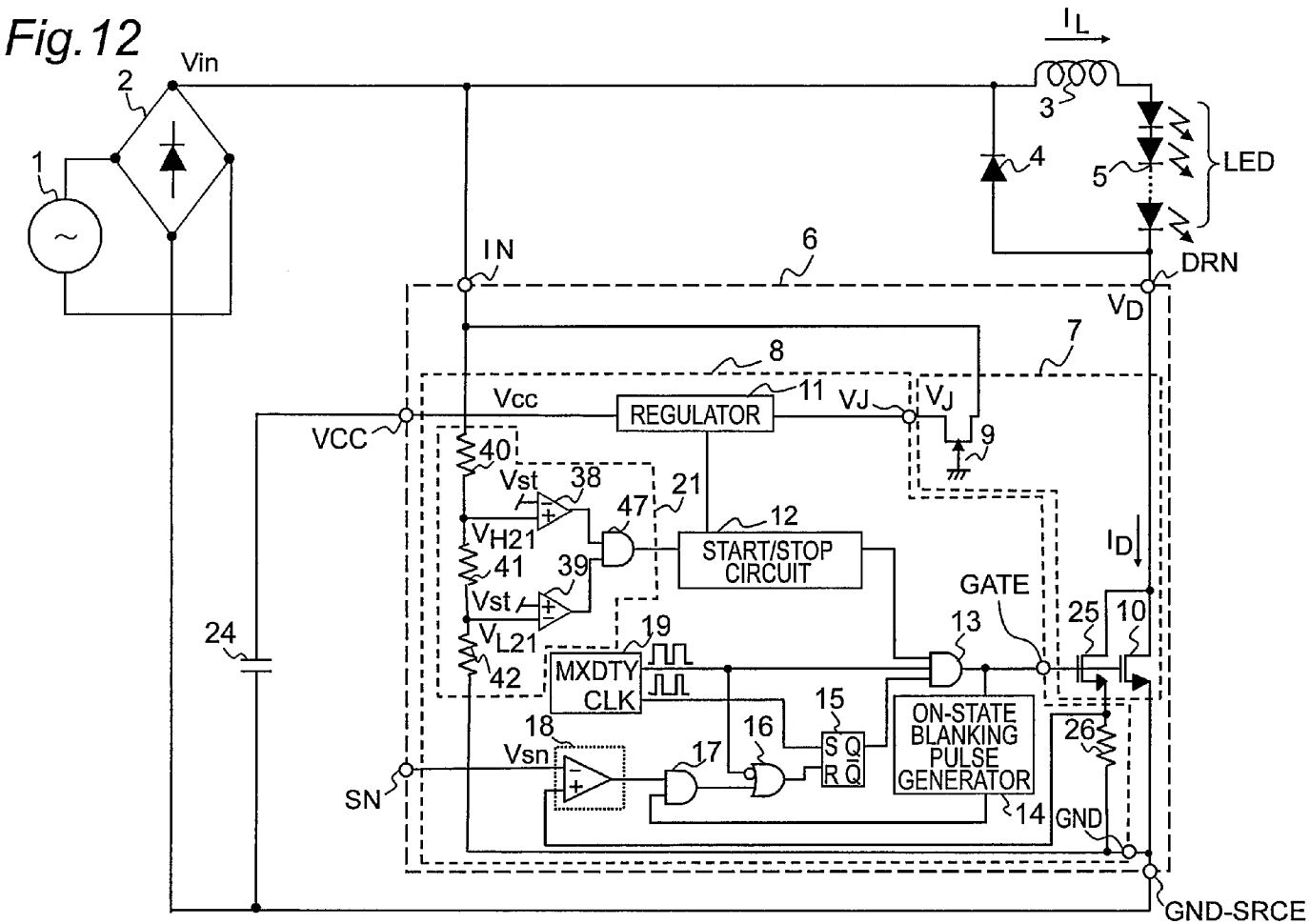
FIG. 12 is a circuit diagram showing a light emitting diode driving apparatus of a seventh embodiment of the present invention.

A light emitting diode driving semiconductor circuit and a light emitting diode driving apparatus of the seventh embodiment of the present invention will now be described using FIG. 12 and FIG. 13. FIG. 12 shows the light emitting diode driving semiconductor circuit and the light emitting diode driving apparatus of the seventh embodiment. The light emitting diode driving apparatus in the seventh embodiment differs from the sixth embodiment regarding the configuration of the input voltage detection circuit 21 in the following aspects.

The input voltage detection circuit 21 of the present embodiment includes three resistors 40, 41 and 42 connected in series between the rectifying voltage terminal IN and the ground terminal GND of the control circuit block 8; a first comparator 38 having the positive input terminal for inputting the first divided voltage $V_{H21}$ output from the connecting point of the resistor 40 and the resistor 41 and the negative input terminal for inputting the input reference voltage Vst; a second comparator 39 having the negative input terminal for inputting the second divided voltage $V_{L21}$ output from the connecting point of the resistor 41 and the resistor 42 and the positive input terminal for inputting the input reference voltage Vst; and an AND circuit 47 having input terminals connected to output terminals of the first comparator 38 and the second comparator 39. An output terminal of the AND circuit 47 is connected to the start/stop circuit 12. The first divided voltage $V_{H21}$ and the second divided voltage $V_{L21}$ are voltages obtained by dividing the full-wave rectified voltage Vin output from the rectifier circuit 2 by three resistors 40, 41 and 42. The relationship of $V_{H21}>V_{L21}$ is always met between the first divided voltage $V_{H21}$ and the second divided voltage $V_{L21}$.

The operation of the light emitting diode driving apparatus of the present embodiment will now be described using FIG. 12 and FIG. 13. FIG. 13 is a diagram showing the waveform of the current $I_L$ flowing in the light emitting diode 5, the first divided voltage $V_{H21}$ and the second divided voltage $V_{L21}$. The horizontal axis shows time t.

The first comparator 38 outputs the signal having a signal level of low level until the first divided voltage $V_{H21}$ reaches the input reference voltage Vst. Since the second divided voltage $V_{L21}$ is lower than the input reference voltage Vst, the second comparator 39 outputs the signal having a signal level of high level. The output signal of the AND circuit 47 which receives the output signals of the two comparators 38, 39 thus becomes low level until the first divided voltage $V_{H21}$ reaches the reference voltage Vst, and thereby the start/stop circuit 12 outputs the low signal of the extinction signal to the AND circuit 13. The control circuit block 8 stops the control of the switching element 10 (extinction period T2A).

When the full-wave rectified voltage Vin rises and the first divided voltage $V_{H21}$ reaches the input reference voltage Vst, the first comparator 38 outputs the signal of high level. Since the second divided voltage $V_{L21}$ is lower than the input reference voltage Vst, the second comparator 39 outputs the signal of high level. Therefore, when the first divided voltage $V_{H21}$ reaches the reference voltage Vst, the output signal of the AND circuit 47 into which the output signals of the two comparator 38 and 39 are input becomes high level, and the start/stop circuit 12 outputs a high signal of a light emitting signal to the AND circuit 13. The intermittent on/off control of the switching element 10 by the control circuit block 8 then starts and the light emitting diode emits light (light emitting period T1).

When the full-wave rectified voltage Vin rises and the second divided voltage $V_{L21}$ reaches the input reference voltage Vst, the second comparator 39 outputs the signal having a signal level of low level. Since the first divided voltage $V_{H21}$ is higher than the input reference voltage Vst, the first comparator 38 continues to output the signal having a signal level of high level. Therefore, when the second divided voltage $V_{L21}$ reaches the reference voltage Vst, the output signal of the AND circuit 47 into which the output signals of the two comparator 38 and 39 are input becomes low level, and the start/stop circuit 12 outputs a low signal of the extinction signal to the AND circuit 13. The control circuit block 8 stops the control the switching element 10 (extinction period T2B).

Subsequently, when the full-wave rectified voltage Vin lowers, the second divided voltage $V_{L21}$, again becomes lower than the input reference voltage Vst, and the switching element 10 enters an oscillating state (light emitting period T1).

When the first divided voltage $V_{H21}$ becomes lower than the input reference voltage Vst, the switching element 10 enters an oscillation stopped state (extinction period T2A).

Figure 13:
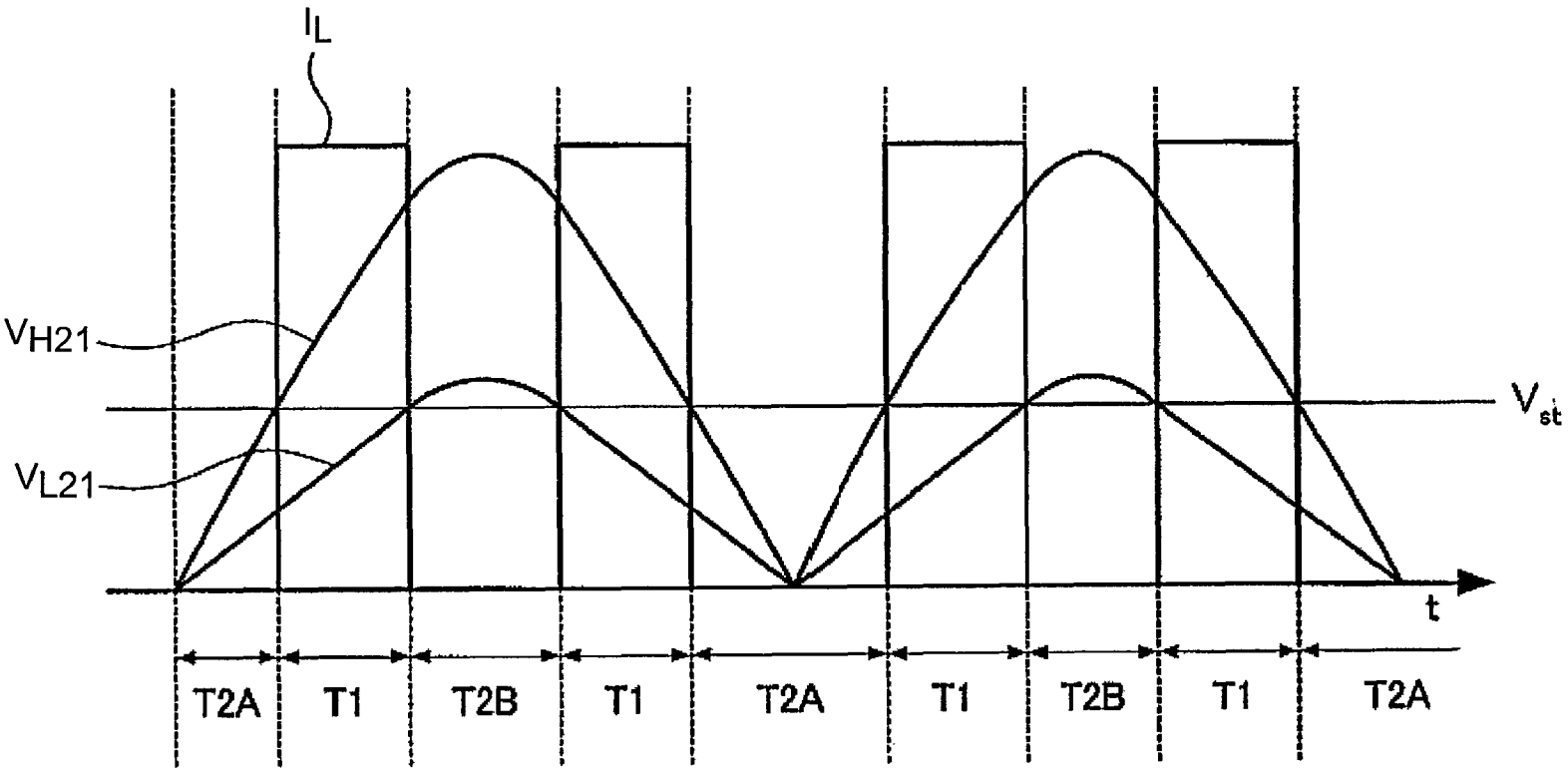
FIG. 13 is a diagram showing a voltage waveform of an input voltage detection circuit of the light emitting driving apparatus of FIG. 12.

That is, the control circuit block 8 stops the on/off control of the switching element 10 and maintains the OFF-state of the switching element 10 during the period T2A in which the first divided voltage $V_{H21}$ is smaller than the input reference voltage Vst, as shown in FIG. 13, and thereby the emission of the light emitting diode 5 is quenched. The ON/OF control of the switching element 10 by the control circuit block 8 becomes possible during the period T1 in which the first divided voltage $V_{H21}$ is higher than the input reference voltage Vst and the second voltage $V_{L21}$ is lower than the input reference voltage Vst, and thereby the light emitting diode emits light. Furthermore, the control circuit block 8 stops the on/off control of the switching element 10 and maintains the OFF-state during the period T2B in which the second divided voltage $V_{L21}$ is higher than the input reference voltage Vst, and thereby the emission of the light emitting diode 5 is quenched.

According to the above configuration, the upper limit value and the lower limit value of the voltage level capable of the on/off control of the switching element 10 can be set with respect to the change in the full-wave rectified voltage Vin. The input voltage detection circuit 21 acts as a protective circuit when abnormal high voltage is applied, and thus the present embodiment realizes a more safe light emitting diode driving apparatus.

In the present embodiment, two divided voltages are generated using three resistors 40, 41 and 42 connected in series, but is not limited thereto, and a configuration that defines the upper limit value and the lower limit value of the voltage level capable of the on/off control of the switching element 10 with respect to the change in the full-wave rectified voltage Vin may be adopted.

One end of the resistor 40 of the input voltage detection circuit 21 may be connected to the input terminal VJ instead of being connected to the rectified voltage terminal IN.

Eighth Embodiment

Figure 14:
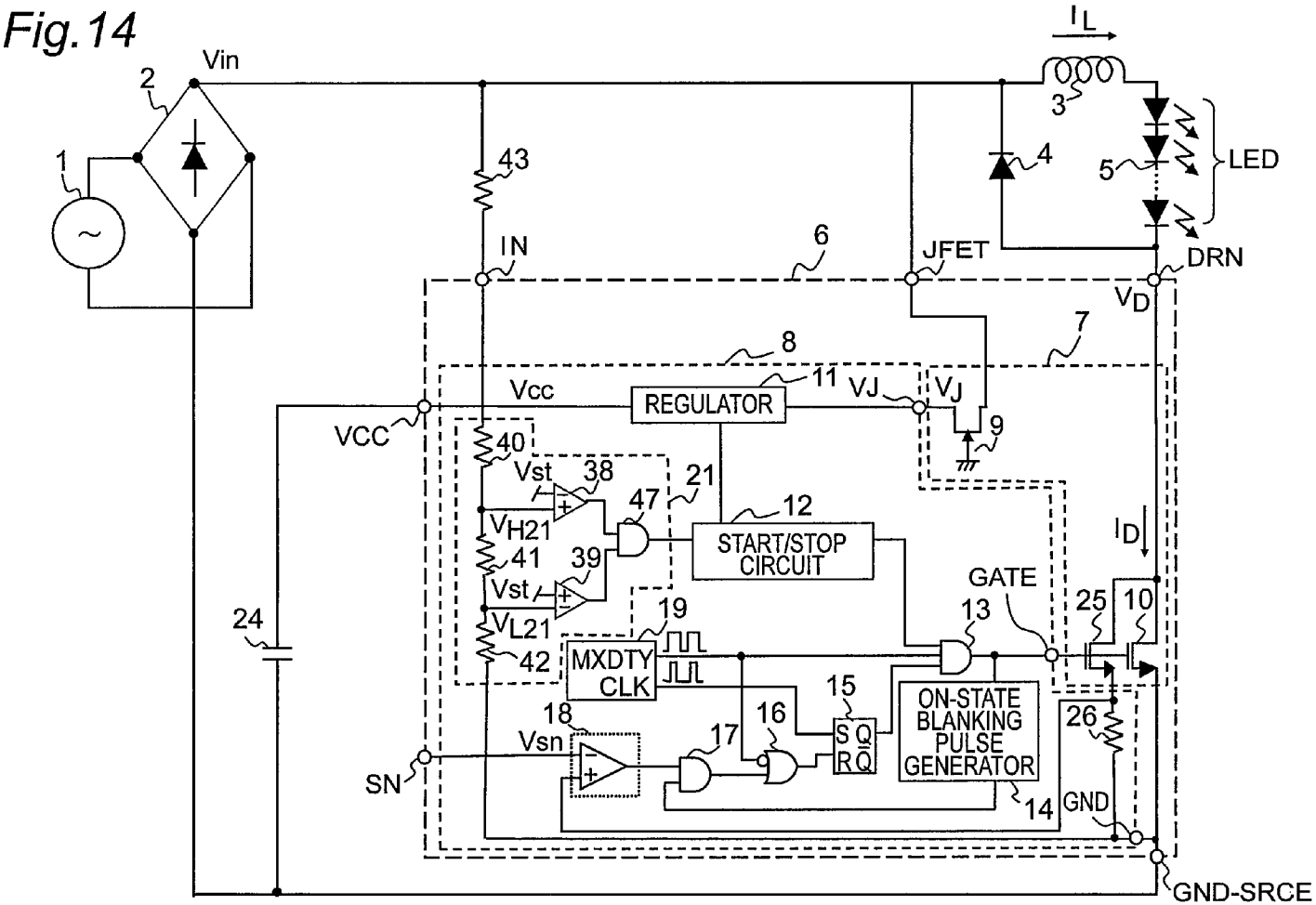
FIG. 14 is a circuit diagram showing a light emitting diode driving apparatus of an eighth embodiment of the present invention.

A light emitting diode driving semiconductor circuit and a light emitting diode driving apparatus of the eighth embodiment of the present invention will now be described using FIG. 14. FIG. 14 shows the light emitting diode driving semiconductor circuit and the light emitting diode driving apparatus of the eighth embodiment.

The light emitting diode driving apparatus in the present embodiment differs from that of the seventh embodiment regarding the connection of the junction type FET 9, and in that a resistor 43 is added between the rectified voltage terminal IN and the rectifier circuit 2. Other configurations of the present embodiment are the same as that of the seventh embodiment.

The high potential side terminal of the junction type FET 9 is connected to the rectified voltage terminal JFET arranged separate from the rectified voltage terminal IN. The resistor 43 has one end connected between the rectifier circuit 2 and the choke coil 3, and the other end connected to the rectified voltage terminal IN which is connected to the high potential side of the resistor 40 of the input voltage detection circuit 21.

According to the above configuration, the upper limit value and the lower limit value of the voltage level capable of the on/off control of the switching element 10 can be arbitrarily set with respect to the change in the full-wave rectified voltage Vin by changing the resistance value of the resistor 43. A safer light emitting diode driving apparatus capable of performing complex luminosity adjustment is thereby realized. The power loss at the resistors 40, 41 and 42 can be reduced by using high resistance for the resistor 43.

Ninth Embodiment

Figure 15:
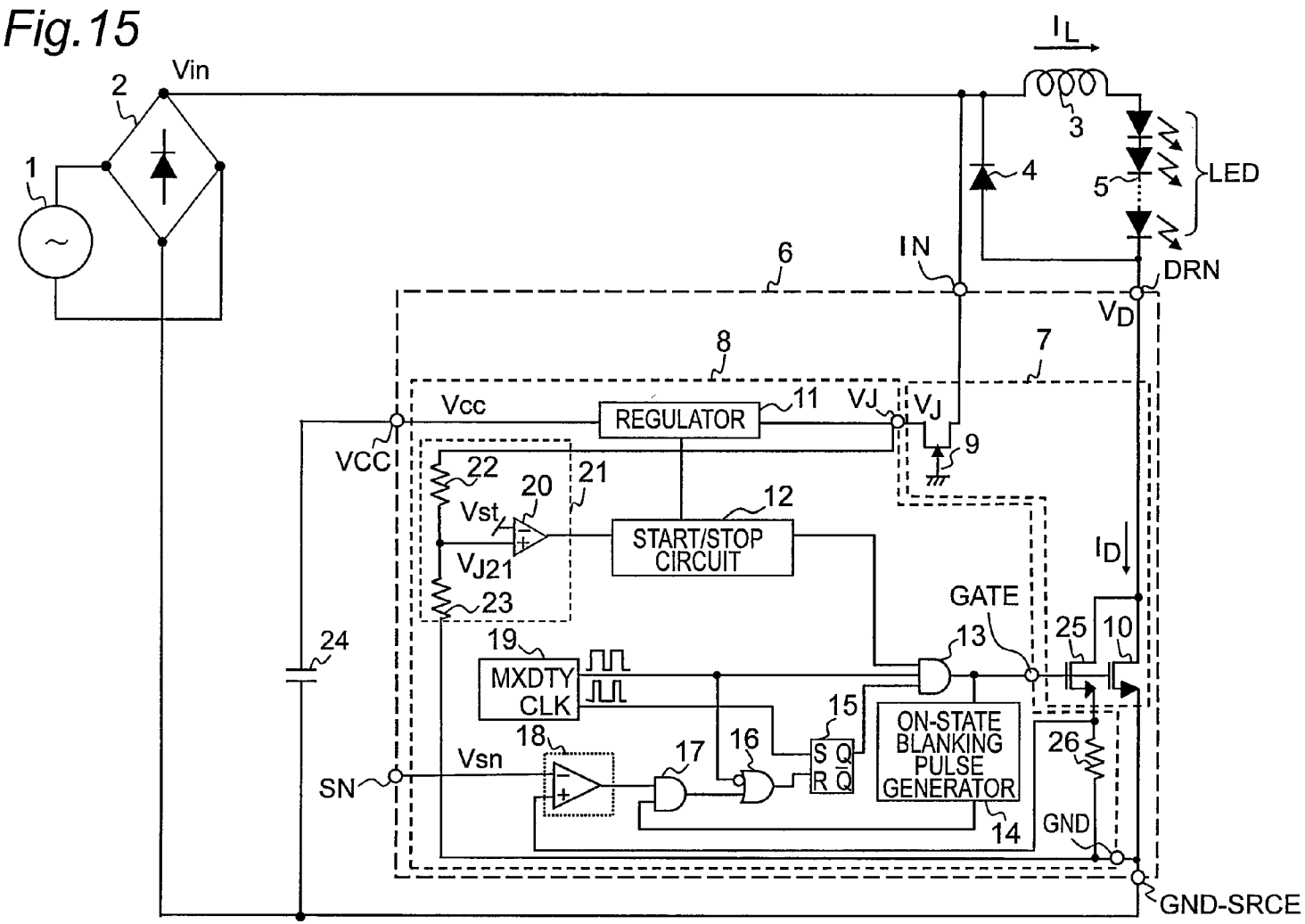
FIG. 15 is a circuit diagram showing a light emitting diode driving apparatus of a ninth embodiment of the present invention.

A light emitting diode riving semiconductor circuit and a light emitting diode driving apparatus of the ninth embodiment of the present invention will now be described using FIG. 15. FIG. 15 shows the light emitting diode driving semiconductor circuit and the light emitting diode driving apparatus of the ninth embodiment of the present invention. The ninth embodiment of the present invention shown in FIG. 15 differs from that of the third embodiment of the present invention shown in FIG. 6 in that the high potential side of the resistors 22 and 23 connected in series of the input voltage detection circuit 21 is connected to the low potential side of the junction FET 9 by way of the input terminal VJ of the control circuit block 8. Other configurations in the ninth embodiment are the same as that of the third embodiment.

The high potential side of the junction type FET 9 of the switching element block 7 is connected to the rectified voltage terminal IN. One end of the resistor 22 is connected to the input terminal VJ, and the low potential side voltage $V_J$ is divided by the resistor 22 and the resistor 23. The comparator 20 compares the divided low potential side voltage $V_{J21}$ with the input reference voltage Vst.

According to the above configuration, the full-wave rectified voltage Vin does not need to be directly divided by the resistor and the low potential side voltage $V_J$ of the junction type FET 9 is divided by the resistor in the ninth embodiment, and thus the power loss generated at the resistors 22 and 23 can be reduced.

Tenth Embodiment

Figure 16:
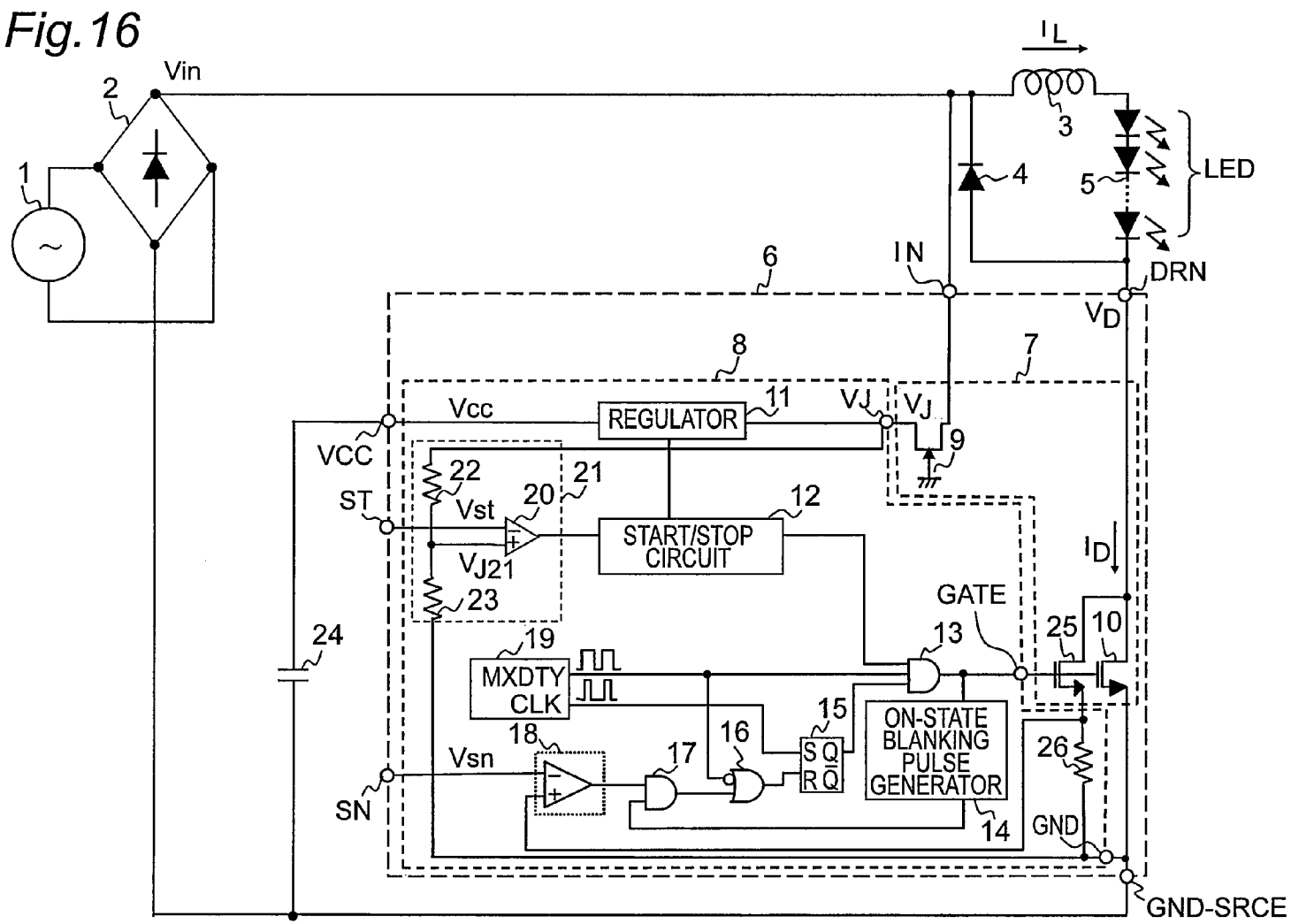
FIG. 16 is a circuit diagram showing a light emitting diode driving apparatus of a tenth embodiment of the present invention.

A light emitting diode riving semiconductor circuit and a light emitting diode driving apparatus of the tenth embodiment of the present invention will now be described using FIG. 16. FIG. 16 shows the light emitting diode driving semiconductor circuit and the light emitting diode driving apparatus of the tenth embodiment. The tenth embodiment of the present invention shown in FIG. 16 differs from that of the fifth embodiment of the present invention shown in FIG. 9 in that the high potential side of the resistors 22 and 23 connected in series of the input voltage detection circuit 21 is connected to the low potential side of the junction FET 9 by way of the input terminal VJ of the control circuit block 8. Other configurations in the tenth embodiment are the same as that of the fifth embodiment.

The high potential side of the junction type FET 9 of the switching element block 7 is connected to the rectified voltage terminal IN. One end of the resistor 22 is connected to the input terminal VJ, and the low potential side voltage $V_J$ is divided by the resistor 22 and the resistor 23. The comparator 20 compares the divided low potential side voltage $V_{J21}$ and the input reference voltage Vst.

The effects of the tenth embodiment are the same as that of the ninth embodiment, and the power loss generated at the resistors 22 and 23 can be reduced.

Eleventh Embodiment

Figure 17:
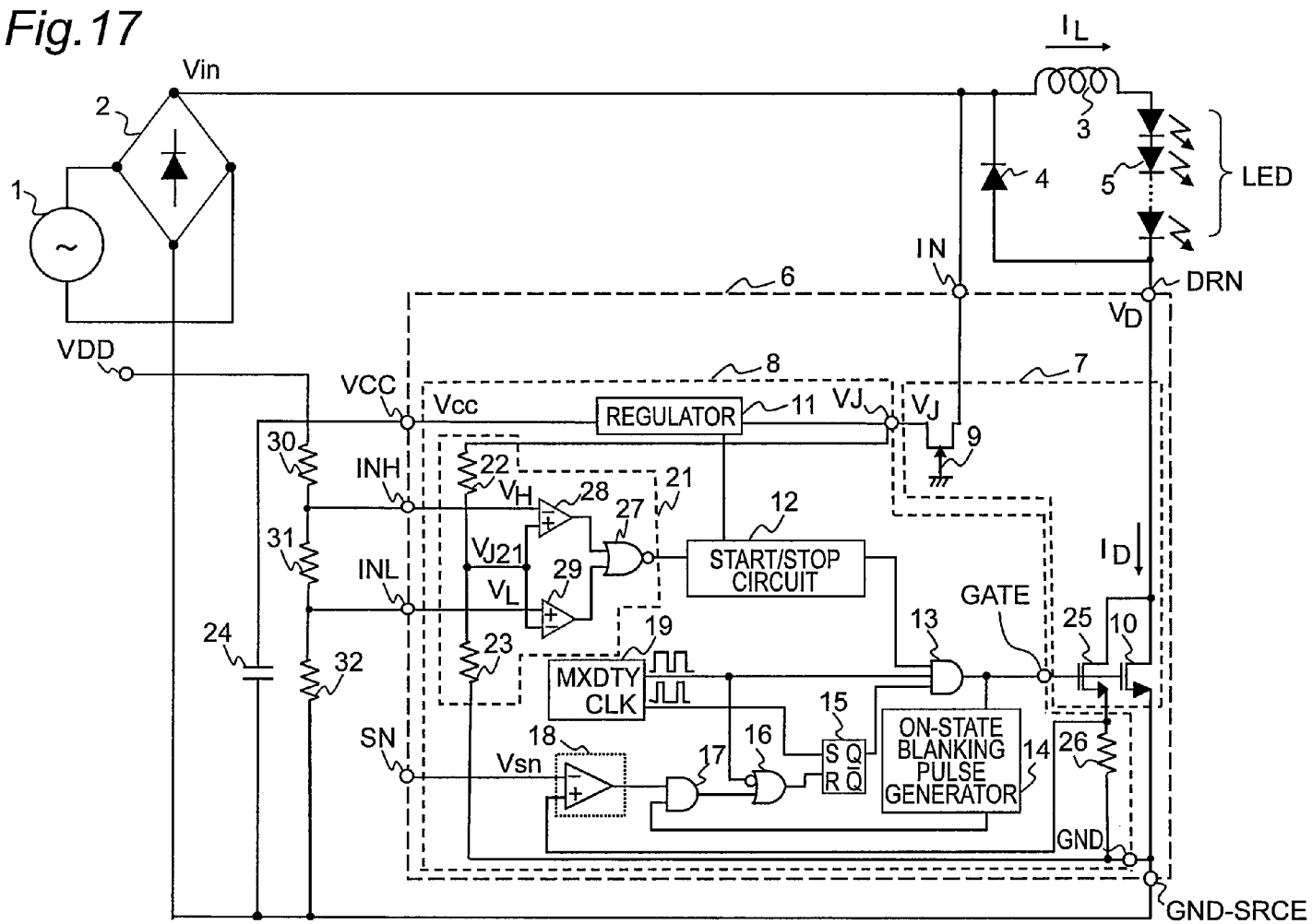
FIG. 17 is a circuit diagram showing a light emitting diode driving apparatus of an eleventh embodiment of the present invention.

A light emitting diode driving semiconductor circuit and a light emitting diode driving apparatus of the eleventh embodiment of the present invention will now be described using FIG. 17. FIG. 17 shows the light emitting diode driving semiconductor circuit and the light emitting diode driving apparatus of the eleventh embodiment. The eleventh embodiment of the present invention shown in FIG. 17 differs from the sixth embodiment of the present invention shown in FIG. 10 in that the high potential side of the resistors 22 and 23 connected in series of the input voltage detection circuit 21 is connected to the low potential side of the junction FET 9 by way of the input terminal VJ of the control circuit block 8. Other configurations in the eleventh embodiment are the same as that of the sixth embodiment.

The high potential side of the junction type FET 9 of the switching element block 7 is connected to the rectified voltage terminal IN. One end of the resistor 22 is connected to the input terminal VJ, and the low potential side voltage $V_J$ is divided by the resistor 22 and the resistor 23. The first comparator 29 compares the divided low potential side voltage $V_{J21}$ with the light emitting voltage $V_L$. The second comparator 28 compares the divided low potential side voltage $V_{J21}$ with the extinction voltage $V_H$.

The effects of the eleventh embodiment are the same as that of the ninth embodiment, and the power loss generated at the resistors 22 and 23 can be reduced.

Twelfth Embodiment

Figure 18:
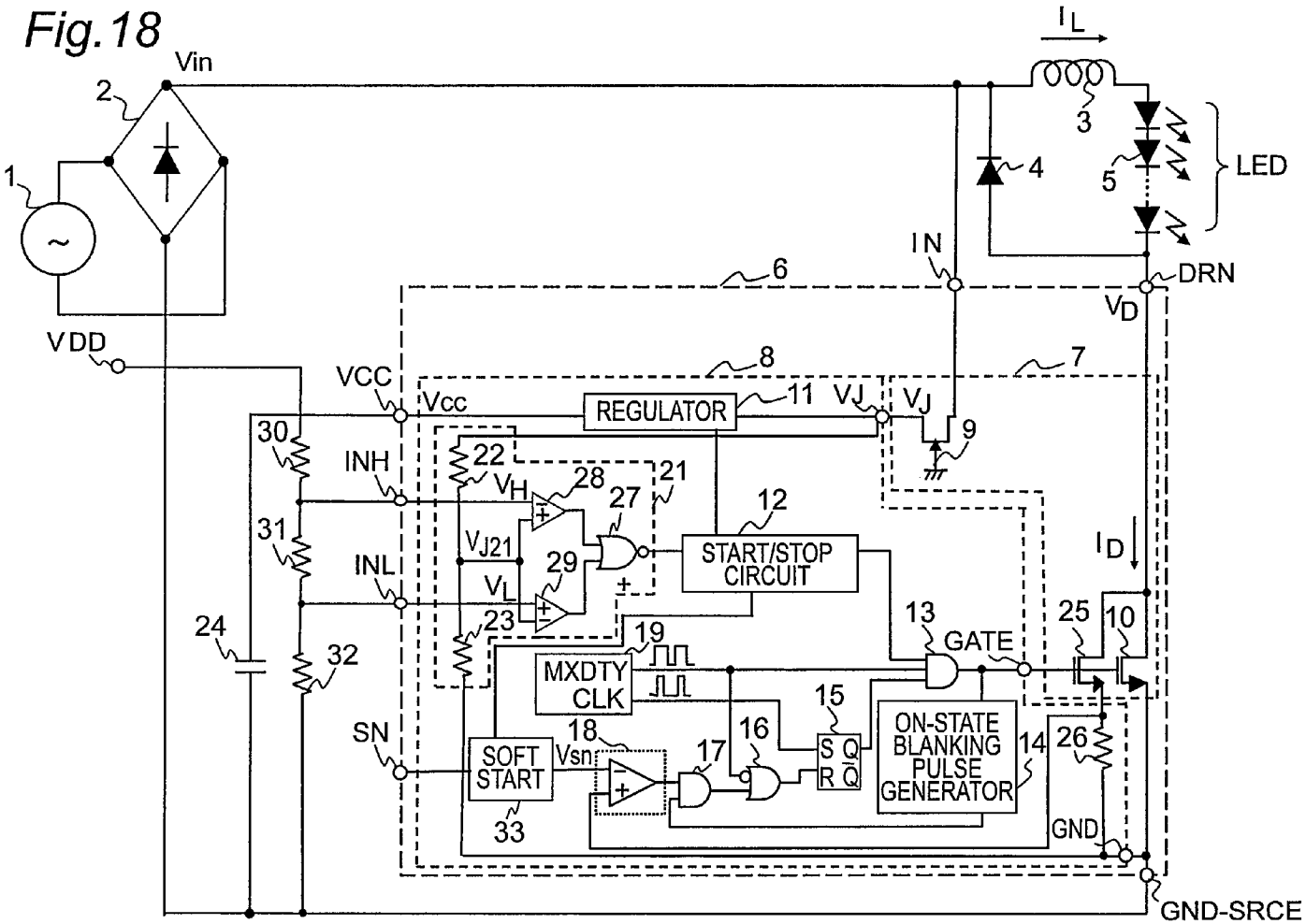
FIG. 18 is a circuit diagram showing a light emitting diode driving apparatus of a twelfth embodiment of the present invention.
Figure 19:
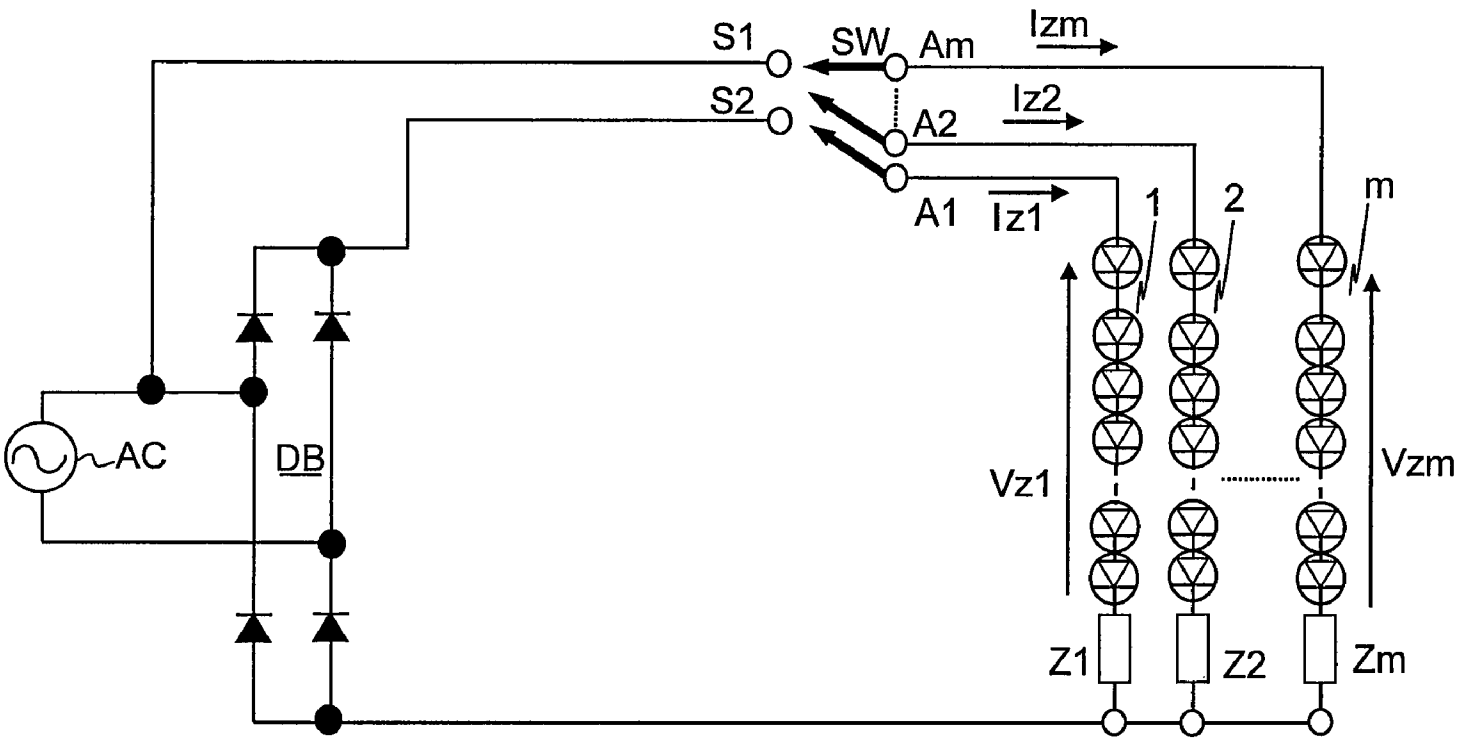
FIG. 19 is a view showing a schematic configuration of a light emitting diode driving apparatus according to the prior art.

A light emitting diode driving semiconductor circuit and a light emitting diode driving apparatus of the twelfth embodiment of the present invention will now be described using FIG. 18. FIG. 18 shows the light emitting diode driving semiconductor circuit and the light emitting diode driving apparatus of the twelfth embodiment. The twelfth embodiment of the present invention shown in FIG. 18 differs from the eleventh embodiment of the present invention shown in FIG. 17 in that a soft start circuit 33 is arranged between the external detection terminal SN and the drain current detection circuit 18, but other configurations are the same as the eleventh embodiment.

The soft start circuit 33 is also connected to the start/stop circuit 12. When the high (H) signal of the light emitting signal is input from the start/stop circuit 12, the soft start circuit 33 outputs the detection reference voltage Vsn so that the detection reference voltage Vsn is gradually increased until reaching a constant value. According to the above configuration, the incoming current generated in time of start-up is prevented. The forward current value of the current $I_L$ flowing into the light emitting diode 5 is gradually increased by gradually increasing the detection reference voltage Vsn. The luminosity of the light emitting diode is thereby gradually increased.

INDUSTRIAL APPLICABILITY

The present invention is useful for all apparatuses and equipments that use the light emitting diode, and is particularly effective as the LED illuminating equipment.

The invention claimed is:

1. A light emitting diode driving semiconductor circuit that is connected to a light emitting diode block including a rectifier circuit that rectifies an alternating-current voltage and one or more light emitting diodes to which a voltage output from the rectifier circuit is applied to emit light, the light emitting diode driving semiconductor circuit comprising:

a junction type FET to which the output voltage of the rectifier circuit is applied directly or by way of the light emitting diode;

a first switching element that is connected between the light emitting diodes and a ground potential; and a control circuit block that controls on/off of the first switching element, the control circuit block comprising:

an input terminal that inputs an output voltage of the junction type FET;

an input voltage detection circuit that detects the voltage output from the rectifier circuit and compares the detected voltage with a predetermined value to output a light emitting signal or a extinction signal for controlling emission or extinction of the light emitting diodes;

a current detection circuit that detects a current flowing into the first switching element; and a control circuit that intermittently controls on/off of the first switching element at a predetermined oscillating frequency based on an output signal of the current detection circuit so that the current flowing into the light emitting diode is constant while the input voltage detection circuit is outputting the light emitting signal, a regulator that is connected to the input terminal and receives the output voltage of the junction type FET to output a constant reference voltage when the output voltage of the junction type FET is greater than or equal to a predetermined value, a start/stop circuit, wherein the control circuit block is driven by applying the output voltage of the junction type FET to the input terminal, each circuit in the control circuit block is driven by applying the constant reference voltage, the regulator outputs a start signal or a stop signal for the on/off control of the first switching element based on whether or not the output voltage of the junction type FET is greater than or equal to the predetermined value, and the start/stop circuit outputs the stop signal to the control circuit when the regulator outputs the stop signal, and outputs the light emitting signal or the extinction signal of the input voltage detection circuit to the control circuit when the regulator outputs the start signal.

2. The light emitting diode driving semiconductor circuit according to claim 1, wherein the junction type FET is connected between the light emitting diode and the first switching element in series with the first switching element, and the connecting point of the junction type FET and the first switching element is connected to the input terminal.

3. The light emitting diode driving semiconductor circuit according to claim 1, wherein one end of the junction type FET is connected between the light emitting diode and the first switching element, and other end of the junction type FET is connected to the input terminal.

4. The light emitting diode driving semiconductor circuit according to claim 1, wherein the junction type FET is connected between the rectifier circuit and the input terminal.

5. A light emitting diode driving semiconductor circuit that is connected to a light emitting diode block including a rectifier circuit that rectifies an alternating-current voltage and one or more light emitting diodes to which a voltage output from the rectifier circuit is applied to emit light, the light emitting diode driving semiconductor circuit comprising:

a junction type FET to which the output voltage of the rectifier circuit is applied directly or by way of the light emitting diode;

a first switching element that is connected between the light emitting diodes and a ground potential; and a control circuit block that controls on/off of the first switching element, the control circuit block comprising:

an input terminal that inputs an output voltage of the junction type FET;

an input voltage detection circuit that detects the voltage output from the rectifier circuit and compares the detected voltage with a predetermined value to output a light emitting signal or a extinction signal for controlling emission or extinction of the light emitting diodes;

a current detection circuit that detects a current flowing into the first switching element; and a control circuit that intermittently controls on/off of the first switching element at a predetermined oscillating frequency based on an output signal of the current detection circuit so that the current flowing into the light emitting diode is constant while the input voltage detection circuit is outputting the light emitting signal, wherein the control circuit block is driven by applying the output voltage of the function type FET to the input terminal, and wherein the input voltage detection circuit includes:

a plurality of resistors which are connected in series to one another and to which the voltage output by the rectifier circuit is applied directly or by way of the junction type FET; and a comparator having a positive input terminal that receives a direct-current voltage divided by the plurality of resistors, and a negative input terminal that receives an input reference voltage of the predetermined value.

6. The light emitting diode driving semiconductor circuit according to claim 5, wherein the voltage value for emitting or quenching the light emitting diode is adjusted by changing the value of the input reference voltage.

7. A light emitting diode driving semiconductor circuit that is connected to a light emitting diode block including a rectifier circuit that rectifies an alternating-current voltage and one or more light emitting diodes to which a voltage output from the rectifier circuit is applied to emit light, the light emitting diode driving semiconductor circuit comprising:

a junction type FET to which the output voltage of the rectifier circuit is applied directly or by way of the light emitting diode;

a first switching element that is connected between the light emitting diodes and a ground potential; and a control circuit block that controls on/off of the first switching element, the control circuit block comprising:

an input terminal that inputs an output voltage of the junction type FET;

an input voltage detection circuit that detects the voltage output from the rectifier circuit and compares the detected voltage with a predetermined value to output a light emitting signal or a extinction signal for controlling emission or extinction of the light emitting diodes;

a current detection circuit that detects a current flowing into the first switching element; and a control circuit that intermittently controls on/off of the first switching element at a predetermined oscillating frequency based on an output signal of the current detection circuit so that the current flowing into the light emitting diode is constant while the input voltage detection circuit is outputting the light emitting signal, wherein the control circuit block is driven by applying the output voltage of the function type FET to the input terminal, and a first external input terminal that receives a light emitting voltage; and a second external input terminal that receives a extinction voltage having a potential higher than the light emitting voltage, wherein the input voltage detection circuit includes:

a plurality of resistors which are connected in series to each other and to which the voltage output by the rectifier circuit is applied directly or by way of the junction type FET;

a first comparator having a negative input terminal connected to an intermediate connecting point of the plurality of resistors, and a positive input terminal connected to the first external input terminal;

a second comparator having a positive input terminal connected to the intermediate connecting point of the plurality of resistors, and a negative input terminal connected to the second external input terminal; and a NOR circuit having input terminals that connected to output terminals of the first comparator and the second comparator, respectively.

8. The light emitting diode driving semiconductor circuit according to claim 1, wherein the input voltage detection circuit includes:

a plurality of resistors to which the voltage output is applied from the rectifier circuit directly or by way of the junction type FET to output a first divided voltage and a second divided voltage having a potential lower than the first divided voltage;

a first comparator having a positive input terminal that receives the first divided voltage, and a negative input terminal that receives an input reference voltage;

a second comparator having a negative input terminal that receives the second divided voltage, and a positive input terminal that receives the input reference voltage; and an AND circuit that receives output signals of the first and second comparators.

9. A light emitting diode driving semiconductor circuit that is connected to a light emitting diode block including a rectifier circuit that rectifies an alternating-current voltage and one or more light emitting diodes to which a voltage output from the rectifier circuit is applied to emit light, the light emitting diode driving semiconductor circuit comprising:

a junction type FET to which the output voltage of the rectifier circuit is applied directly or by way of the light emitting diode;

a first switching element that is connected between the light emitting diodes and a ground potential; and a control circuit block that controls on/off of the first switching element, the control circuit block comprising:

an input terminal that inputs an output voltage of the junction type FET;

an input voltage detection circuit that detects the voltage output from the rectifier circuit and compares the detected voltage with a predetermined value to output a light emitting signal or a extinction signal for controlling emission or extinction of the light emitting diodes;

a current detection circuit that detects a current flowing into the first switching element; and a control circuit that intermittently controls on/off of the first switching element at a predetermined oscillating frequency based on an output signal of the current detection circuit so that the current flowing into the light emitting diode is constant while the input voltage detection circuit is outputting the light emitting signal, wherein the control circuit block is driven by applying the output voltage of the junction type FET to the input terminal, and wherein the input voltage detection circuit includes:

a plurality of resistors to which the voltage output is applied from the rectifier circuit directly or by way of the junction type FET to output a first divided voltage and a second divided voltage having a potential lower than the first divided voltage;

a first comparator having a positive input terminal that receives the first divided voltage, and a negative input terminal that receives an input reference voltage;

a second comparator having a negative input terminal that receives the second divided voltage, and a positive input terminal that receives the input reference voltage; and an AND circuit that receives output signals of the first and second comparators, and wherein the input voltage detection circuit receives the output voltage of the rectifier circuit by way of a resistor connected between the rectifier circuit and the input voltage detection circuit.

10. The light emitting diode driving semiconductor circuit according to claim 1, wherein the current detection circuit detects the current flowing into the first switching element by comparing the on-voltage of the first switching element with a detection reference voltage of a reference.

11. The light emitting diode driving semiconductor circuit according to claim 10, wherein the ON-period in the intermittent on/off control of the first switching element is changed by changing the value of the detection reference voltage to adjust a constant current level flowing into the light emitting diode.

12. The light emitting diode driving semiconductor circuit according to claim 10, wherein a soft start circuit is connected between an external detection terminal that receives the detection reference voltage and the current detection circuit; and the soft start circuit outputs the detection reference voltage so as to gradually increase until reaching a constant value.

13. A light emitting diode driving semiconductor circuit that is connected to a light emitting diode block, the circuit comprising:

a rectifier circuit that rectifies an alternating-current voltage; and one or more light emitting diodes to which a voltage output from the rectifier circuit is applied to emit light, the light emitting diode driving semiconductor circuit comprising:

a first switching element that is connected between the light emitting diodes and a ground potential; and a control circuit block that controls on/off of the first switching element, the control circuit block comprising:

an input voltage detection circuit that detects the voltage output from the rectifier circuit and compares the detected voltage with a predetermined value to output a light emitting signal or a extinction signal for controlling emission or extinction of the light emitting diodes;

a current detection circuit that detects a current flowing into the first switching element; and a control circuit that intermittently controls on/off of the first switching element at a predetermined oscillating frequency based on an output signal of the current detection circuit so that the current flowing into the light emitting diode is constant while the input voltage detection circuit is outputting the light emitting signal, a second switching element that has one end connected to a connecting point of the light emitting diode and the first switching element, and that performs switching by the same control as the first switching element from the control circuit to cause a current to flow into the second switching element, the current being smaller than the current flowing into the first switching element and having a constant current ratio with respect to the current flowing through the first switching element; and a resistor connected in series between other end of the switching element and the ground potential; wherein the current detection circuit compares voltages at both ends of the resistor with a detection reference voltage of a reference to detect the current flowing into the first switching element.

14. The light emitting diode driving semiconductor circuit according to claim 13, wherein the ON-period in the intermittent on/off control of the first switching element is changed by changing the value of the detection reference voltage to adjust a constant current level flowing into the light emitting diode.

15. The light emitting diode driving semiconductor circuit according to claim 13, wherein a soft start circuit is connected between an external detection terminal that receives the detection reference voltage and the current detection circuit; and the soft start circuit outputs the detection reference voltage so as to gradually increase until reaching a constant value.

16. A light emitting diode driving apparatus comprising:

a rectifier circuit that rectifies an alternating-current voltage;

one or more light emitting diodes to which a voltage output from the rectifier circuit is applied to emit light; and a light emitting diode driving semiconductor circuit according to claim 1.

17. The light emitting diode driving apparatus according to claim 16, further comprising:

a choke coil connected between the rectifier circuit and the light emitting diode; and a diode that has one end connected to the choke coil and other end connected to the light emitting diode, and that supplies back electromotive force generated at the choke coil to the light emitting diode; wherein a reverse recovery time of the diode is less than or equal to 100 nsec.

18. A light emitting diode driving semiconductor circuit that is connected to a light emitting diode block including a rectifier circuit that rectifies an alternating-current voltage and one or more light emitting diodes to which a voltage output from the rectifier circuit is applied to emit light, the light emitting diode driving semiconductor circuit comprising:

a first switching element that is connected between the light emitting diodes and a ground potential;

a control circuit block that controls on/off of the first switching element;

a first external input terminal that receives a light emitting voltage; and a second external input terminal that receives a extinction voltage having a potential higher than the light emitting voltage, the control circuit block comprising:

an input voltage detection circuit that detects the voltage output from the rectifier circuit and compares the detected voltage with a predetermined value to output a light emitting signal or a extinction signal for controlling emission or extinction of the light emitting diodes;

a current detection circuit that detects a current flowing into the first switching element; and a control circuit that intermittently controls on/off of the first switching element at a predetermined oscillating frequency based on an output signal of the current detection circuit so that the current flowing into the light emitting diode is constant while the input voltage detection circuit is outputting the light emitting signal, the input voltage detection circuit comprising:

a plurality of resistors which are connected in series to each other and to which the voltage output by the rectifier circuit is applied directly or by way of a junction type FET;

a first comparator having a negative input terminal connected to an intermediate connecting point of the plurality of resistors, and a positive input terminal connected to the first external input terminal;

a second comparator having a positive input terminal connected to the intermediate connecting point of the plurality of resistors, and a negative input terminal connected to the second external input terminal; and a NOR circuit having input terminals that connected to the output terminals of the first comparator and the second comparator, respectively.

19. A light emitting diode driving semiconductor circuit that is connected to a light emitting diode block including a rectifier circuit that rectifies an alternating-current voltage and one or more light emitting diodes to which a voltage output from the rectifier circuit is applied to emit light, the light emitting diode driving semiconductor circuit comprising;

a first switching element that is connected between the light emitting diodes and a ground potential;

a control circuit block that controls on/off of the first switching element; and a second switching element that has one end connected to a connecting point of the light emitting diode and the first switching element, and that performs switching by the same control as the first switching element from the control circuit block to cause a current to flow into the second switching element, the current being smaller than the current flowing into the first switching element and having a constant current ratio with respect to the current flowing through the first switching element, the control circuit block comprising:

an input voltage detection circuit that detects the voltage output from the rectifier circuit and compares the detected voltage with a predetermined value to output a light emitting signal or a extinction signal from controlling emission or extinction of the light emitting diodes;

a current detection circuit that detects a current flowing into the first switching element;

a control circuit that intermittently controls on/off of the first switching element at a predetermined oscillating frequency based on an output signal of the current detection circuit so that the current flowing into the light emitting diode is constant while the input voltage detection circuit is outputting the light emitting signal; and a resistor connected in series between other end of the switching element and the ground potential, wherein the current detection circuit compares voltages at both ends of the resistor with a detection reference voltage of a reference to detect the current flowing into the first switching element.

* * * * *

UNITED STATES PATENT AND TRADEMARK OFFICE

CERTIFICATE OF CORRECTION

PATENT NO. : 7,830,097 B2
APPLICATION NO. : 11/720868
DATED : November 9, 2010
INVENTOR(S) : Takashi Kunimatsu It is certified that error appears in the above-identified patent and that said Letters Patent is hereby corrected as shown below:

On the Cover Page, insert item [30], Foreign Application Priority Data:

--Dec. 14, 2004 (JP) 2004-361883--

Signed and Sealed this
Twenty-second Day of February, 2011

David J. Kappos

David J. Kappos
*Director of the United States Patent and Trademark Office*